US006342881B1

(12) United States Patent
Inoue

(10) Patent No.: US 6,342,881 B1
(45) Date of Patent: Jan. 29, 2002

(54) DISPLAY DEVICE, ELECTRONIC EQUIPMENT, AND DRIVING METHOD

(75) Inventor: Akira Inoue, Nagano (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/051,764

(22) PCT Filed: Aug. 11, 1997

(86) PCT No.: PCT/JP97/02814

§ 371 Date: Jul. 24, 1998

§ 102(e) Date: Jul. 24, 1998

(87) PCT Pub. No.: WO98/08133

PCT Pub. Date: Feb. 26, 1998

(30) Foreign Application Priority Data

Aug. 16, 1996 (JP) ..... 8-234695

(51) Int. Cl.[7] ..... G09G 3/36

(52) U.S. Cl. ..... 345/204; 345/94; 345/89; 345/95; 345/96; 345/98; 345/208; 345/209; 345/210

(58) Field of Search ..... 345/89, 94, 95, 345/96, 98, 208, 209, 210, 84, 204

(56) References Cited

U.S. PATENT DOCUMENTS

| | | | | | |
|---|---|---|---|---|---|
| 5,159,325 | A | * | 10/1992 | Kuijk et al. | 345/84 |
| 5,233,340 | A | * | 8/1993 | Yamaguchi et al. | 345/148 |
| 5,317,334 | A | * | 5/1994 | Sano | 345/148 |
| 5,534,889 | A | * | 7/1996 | Reents et al. | 345/132 |
| 5,619,224 | A | * | 4/1997 | Hoshino et al. | 345/98 |
| 5,689,281 | A | * | 11/1997 | Nomura | 348/94 |
| 5,719,590 | A | * | 2/1998 | Shimada et al. | 345/94 |
| 5,815,131 | A | * | 9/1998 | Taniguchi et al. | 345/94 |
| 6,069,603 | A | * | 5/2000 | Knapp | 345/91 |

FOREIGN PATENT DOCUMENTS

| | | | |
|---|---|---|---|
| JP | 62-189434 | * | 8/1987 |
| JP | 2-125225 | | 5/1990 |
| JP | 5-93898 | | 4/1993 |
| JP | 6-301011 | | 10/1994 |
| JP | 10082980 | * | 3/1998 |

* cited by examiner

*Primary Examiner*—Bipin Shalwala
*Assistant Examiner*—Vincent E. Kovalick
(74) *Attorney, Agent, or Firm*—Harness, Dickey & Pierce, P.L.C.

(57) ABSTRACT

A display device, an electronic apparatus, and a drive method are provided achieving an improved display characteristic, most suitable for a charge-discharge drive method and arranged to perform grayshade display by pulse width modulation. In a charging mode, a first selecting voltage $V_{S1}$ is supplied to a scanning line. In a discharging mode, a precharge voltage$-V_{PRE}$ opposite in polarity to $V_{S1}$ is applied to the scanning line, and a second selecting voltage $V_{S2}$ opposite in polarity to the precharge voltage$-V_{PRE}$ is thereafter supplied to the scanning line. Also, a pulse-width-modulated data voltage is supplied to a data line. As the pulse width of one of first and second write pulses 44 and 46 setting the same gray scale value is increased, the pulse width of the other is reduced and the rate of reduction of the pulse width of the other becomes lower. The DC component of the data voltage in one horizontal scanning period is made approximately zero independent of the gray scale.

6 Claims, 21 Drawing Sheets

(A)

(B)

(A)

(B)

(A)

(B)

(A)

(B)

(A)

(B)

(C)

DISPLAY DEVICE, ELECTRONIC EQUIPMENT, AND DRIVING METHOD

TECHNICAL FIELD

The present invention relates to a display device, to an electronic apparatus using the display device, and to drive method.

BACKGROUND ART

Recently, liquid crystal displays, which are display devices of one of various kinds, have been widely used as light low-power-consumption display devices for electronic apparatuses such as television sets, electronic notebooks, personal computers and portable telephone sets. With respect to such liquid crystal displays, a further increase in the number of gray scale steps for improvement in the accuracy with which images are displayed is expected. Known techniques for realizing grayshade display with such liquid crystal displays are, for example, pulse height modulation of changing the height of pulses written to liquid crystal elements and pulse width modulation of changing the width of written pulses.

Recently, a drive method using a new system has attracted attention, which system is operated in a liquid crystal display using a nonlinear switching element such as a MIM element, a back-to-back diode element, a diode ring element or a varistor element in such a manner that, in a first mode, a first selecting voltage is supplied to a scanning line, and, in a second mode, a precharge voltage is supplied to the scanning line and a second selecting voltage is thereafter supplied to the scanning line. (This kind of method will hereinafter be referred to as a charge-discharge drive method.) For example, Japanese Patent Laid-Open No. 125225/1990 discloses a charge-discharge drive method. As described in this document, it has been considered that the mainstream of this kind of drive method is grayshade display by pulse height modulation. Pulse height modulation, however, entails the problem of difficulty in voltage control for display with a predetermined gray scale and the problem of a high cost of the liquid crystal display. On the other hand, a drive method which has been proposed or put to use before the charge-discharge drive method and which is called a four-value method because of use of a two-value selecting voltage and a two-value data voltage is also known. The idea of pulse width modulation in the four-value drive method, however, cannot be applied directly to the charge-discharge drive method.

The present invention has been achieved in consideration of the above-described problems, and an object of the present invention is to provide a display device having improved display characteristics, most suitable for the charge-discharge drive method and capable of grayshade display by pulse width modulation, an electronic apparatus using the display device, and a drive method.

DISCLOSURE OF INVENTION

To achieve the above-described object, according to the present invention, there is provided a display device including a plurality of scanning lines, a plurality of data lines, and display elements driven with the scanning lines and the data lines, the display device performing grayshade display by pulse width modulation, the display device comprising scanning signal drive means for supplying a first selecting voltage to the scanning lines in a first mode, and for supplying, in a second mode, a precharge voltage opposite in polarity to the first selecting voltage about a middle value of a data voltage applied to the data lines and thereafter supplying a second selecting voltage opposite in polarity to the precharge voltage about the middle value of the data voltage to the scanning lines, and data signal drive means for supplying a pulse-width-modulated data voltage to the data lines, wherein first and second write pulses formed by the first and second selecting voltages and data voltage in the first and second modes and setting the same gray scale value are such that, as the pulse width of one of the first and second write pulses is increased, the pulse width of the other is reduced and the rate of reduction of the pulse width of the other becomes lower.

The present invention enables driving of display elements using a so-called charge-discharge drive method. According to the present invention, as the pulse width of one of the first and second write pulses is increased, the pulse width of the other is reduced and the rate of this reduction becomes lower.

In this manner, the present invention enables suitable grayshade display using pulse width modulation while preventing application of a DC voltage to each display element over a long time period.

In the present invention, the precharge voltage may be positive or negative, and driving using a positive precharge voltage and driving using a negative precharge voltage may be mixedly performed.

The present invention also provides a display device including a plurality of scanning lines, a plurality of data lines, and display elements driven with the scanning lines and the data lines, the display device performing grayshade display by pulse width modulation, the display device comprising scanning signal drive means for supplying a first selecting voltage to the scanning lines in a first mode, and for supplying, in a second mode, a precharge voltage opposite in polarity to the first selecting voltage about a middle value of a data voltage applied to the data lines and thereafter supplying a second selecting voltage opposite in polarity to the precharge voltage about the middle value of the data voltage to the scanning lines, and data signal drive means for supplying a pulse-width-modulated data voltage to the data lines, wherein first and second write pulses formed by the first and second selecting voltages and data voltage in the first and second modes and setting the same gray scale value have pulse widths set to such values that voltages applied to each of the display elements immediately after the periods of selecting by the first and second selecting voltages are approximately equal to each other.

According to the present invention, the pulse widths of the first and second pulses are set to such values that voltages applied to each of the display elements immediately after the selecting periods (voltages applied at initial stages of holding periods) are approximately equal to each other with respect to the first mode and the second mode, thereby enabling suitable grayshade display using pulse width modulation.

The present invention also provides a display device including a plurality of scanning lines, a plurality of data lines, and display elements driven with the scanning lines and the data lines, the display device performing grayshade display by pulse width modulation, the display device comprising scanning signal drive means for supplying a first selecting voltage to the scanning lines in a first mode, and for supplying, in a second mode, a precharge voltage opposite in polarity to the first selecting voltage about a middle value of a data voltage applied to the data lines and thereafter supplying a second selecting voltage opposite in polarity to the precharge voltage about the middle value of the data voltage to the scanning lines, and data signal drive means for supplying a pulse-width-modulated data voltage to the data lines, wherein a DC component of the data voltage in one horizontal scanning period with respect to a middle voltage between an ON voltage and an OFF voltage is made approximately zero independent of the gray scale.

According to the present invention, the proportion of data signal formed of the ON voltage and the proportion of data signal portion formed of the OFF voltage in one horizontal scanning period can be made approximately equal to each other regardless of the display pattern, thereby effectively preventing occurrence of a vertical crosstalk or the like.

The present invention is also characterized in that the scanning signal drive means supplies, in the first mode, the first selecting voltage in a second period following a first period corresponding to the first half of one horizontal scanning period and equal in length to the first period, and supplies, in the second mode, the precharge voltage in a third period corresponding to the first half of one horizontal scanning period, and the second selecting voltage in a fourth period following the third period and equal in length to the third period, and that the data signal drive means keeps the data voltage at a low level with respect to the middle voltage of the ON and OFF voltages for a period in the first period equal in length to the period in the second period through which the data voltage is kept at a high level with respect to the middle voltage, keeps the data voltage at the high level for a period in the first period equal in length to the period in the second period through which the data voltage is kept at the low level, keeps the data voltage at the low level for a period in the third period equal in length to the period in the fourth period through which the data voltage is kept at the high level, and keeps the data voltage at the high level for a period in the third period equal in length to the period in the fourth period through which the data voltage is kept at the low level. In this manner, the DC component of the data voltage in one horizontal period can be made approximately zero independent of the gray scale, thereby preventing occurrence of a vertical crosstalk or the like. Advantageously, according to the present invention, the data signals in the first and third periods can easily be obtained by inverting the data signals in the second and fourth periods.

The present invention also provides an electronic apparatus comprising one of the above-described display devices. Thus, a display device used in an electronic apparatus such as a remote controller, an electronic calculator, a portable telephone set, a projector, or a personal computer can be improved in display characteristics and can be reduced in cost.

BEST MODE FOR CARRYING OUT THE INVENTION

The embodiments of the present invention will be described below with reference to the drawings.

(First Embodiment)

A charge-discharge drive method will first be described in detail.

Figure 1:
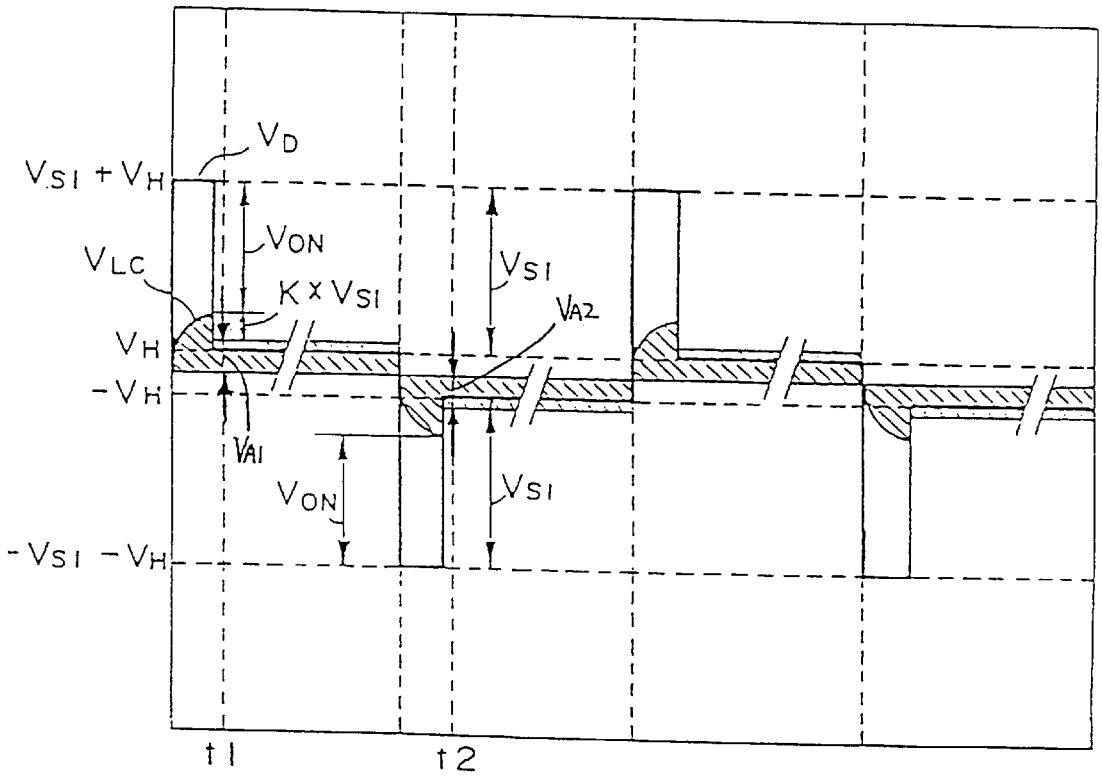
FIG. 1 is a diagram showing an example of drive waveforms of a four-value drive method.
Figure 2:
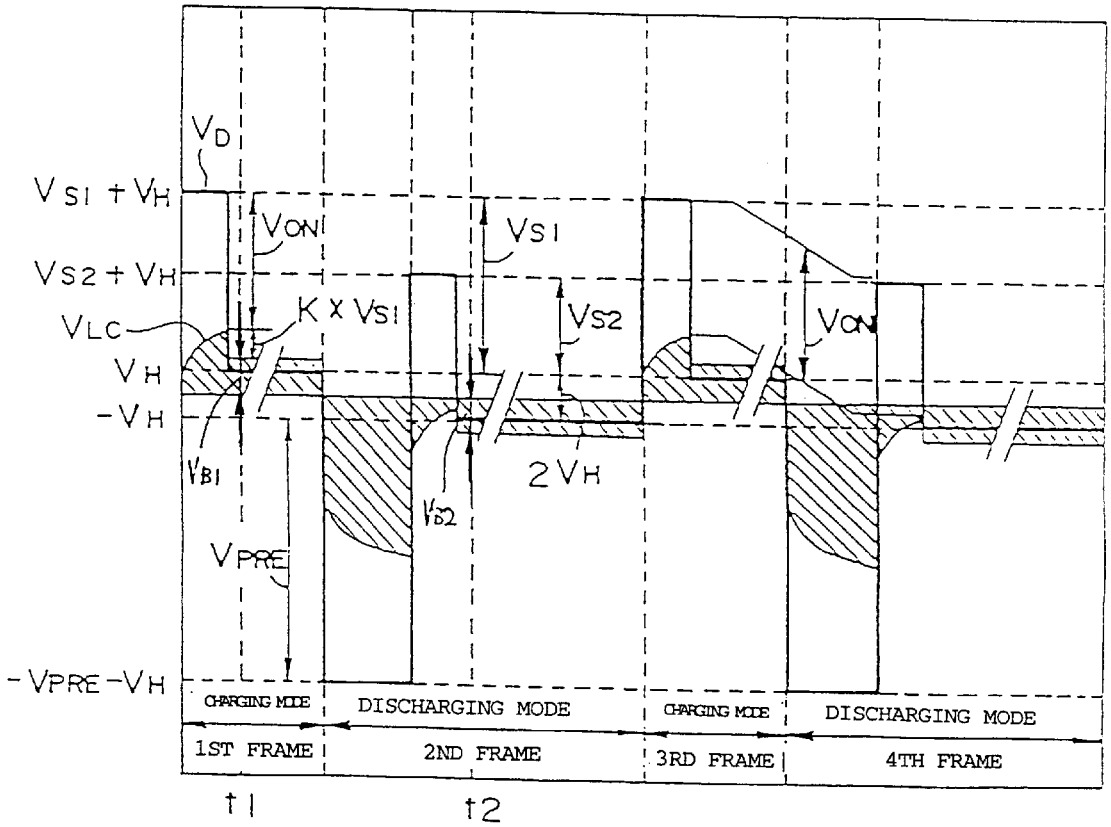
FIG. 2 is a diagram showing an example of drive waveforms of a charge-discharge method.
Figure 3:
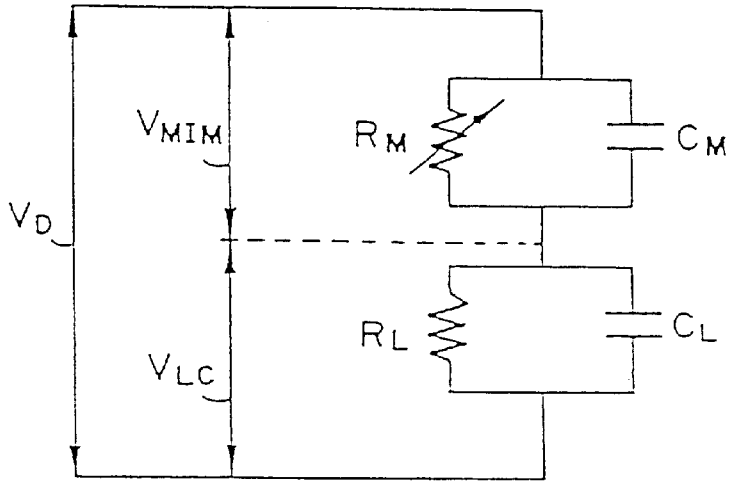
FIG. 3(A) is a diagram showing an equivalent circuit of a pixel of a liquid crystal panel.
FIG. 3(B) is a diagram showing an I–V characteristic of a MIM element.
Figure 3:
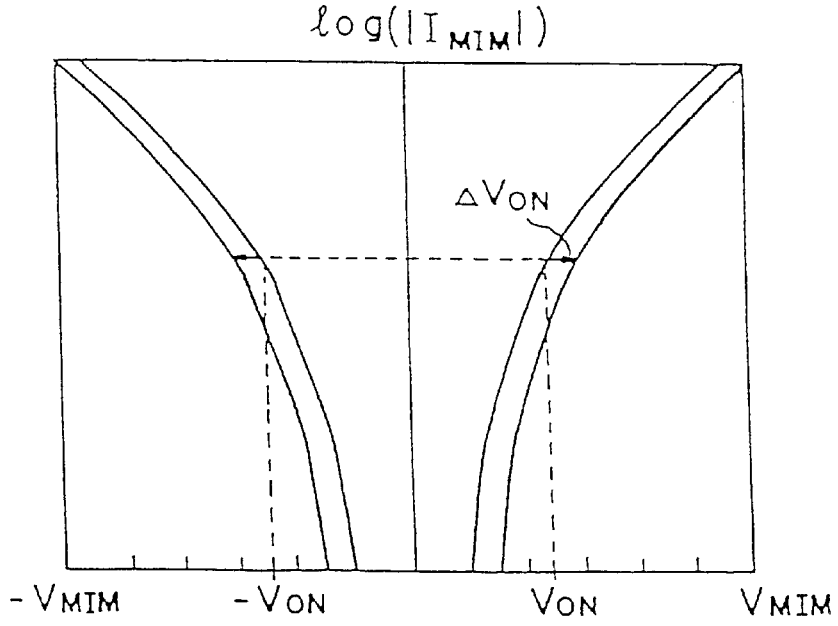
Figure 3A:
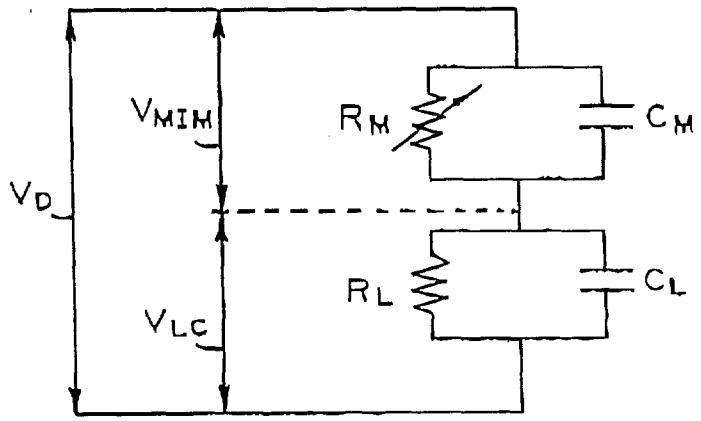

FIG. 1 shows an example of drive waveforms of a four-value drive method which is a conventional drive method, and FIG. 2 shows an example of drive waveforms of a charge-discharge drive method. FIG. 3(A) shows an equivalent circuit relating to one pixel of a liquid crystal panel. A MIM element which is one of nonlinear switching elements, and a liquid crystal element which is one of display elements can be represented by a parallel circuit of a resistor $R_M$ and a capacitor $C_M$ and a parallel circuit of a resistor $R_L$ and a capacitor $C_L$, respectively. FIGS. 1 and 2 illustrate the waveform of a voltage $V_D$ applied to two terminals of a MIM element and a liquid crystal element connected in series, and the waveform of a voltage $V_{LC}$ applied to two terminals of the liquid crystal element.

In the four-value drive method shown in FIG. 1, voltages $V_{A1}$ and $V_{A2}$ each applied to one liquid crystal element (or to the pixel electrode) immediately after the end of a selecting period ($V_{LC}$ at time $t_1$ or $t_2$) are $$V_{A1}=(V_{S1}+V_H-V_{ON})-K\cdot V_{S1} \quad (1)$$

$$V_{A2}=-[(V_{S1}+V_H-V_{ON})-K\cdot V_{S1}] \quad (2)$$

where $V_{S1}$ is a selecting voltage of a scanning signal, $V_H$ is an ON voltage or OFF voltage of a data signal, and $K=C_M/(C_H+C_L)$. Also, $V_{ON}$ is $V_{MIM}$ which is applied to the MIM element immediately before the end of each selecting period. The value of $V_{ON}$ depends upon the I–V characteristic of the MIM element shown in FIG. 3(B). In other words, the $V_{ON}$ is a voltage applied to the MIM element when charging to the liquid crystal element is nearly stopped (when the current through the MIM element becomes about $10^{-9}$ to $10^{-8}$ amperes).

Figure 3B:
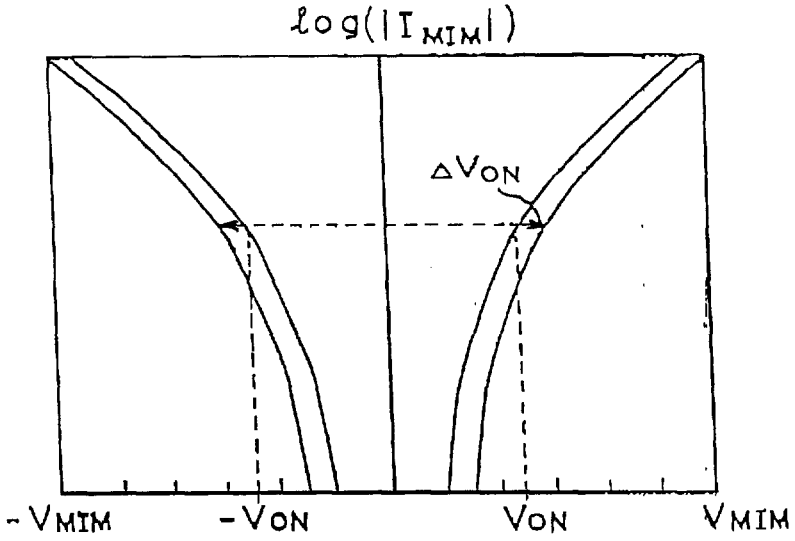
Figure 4:
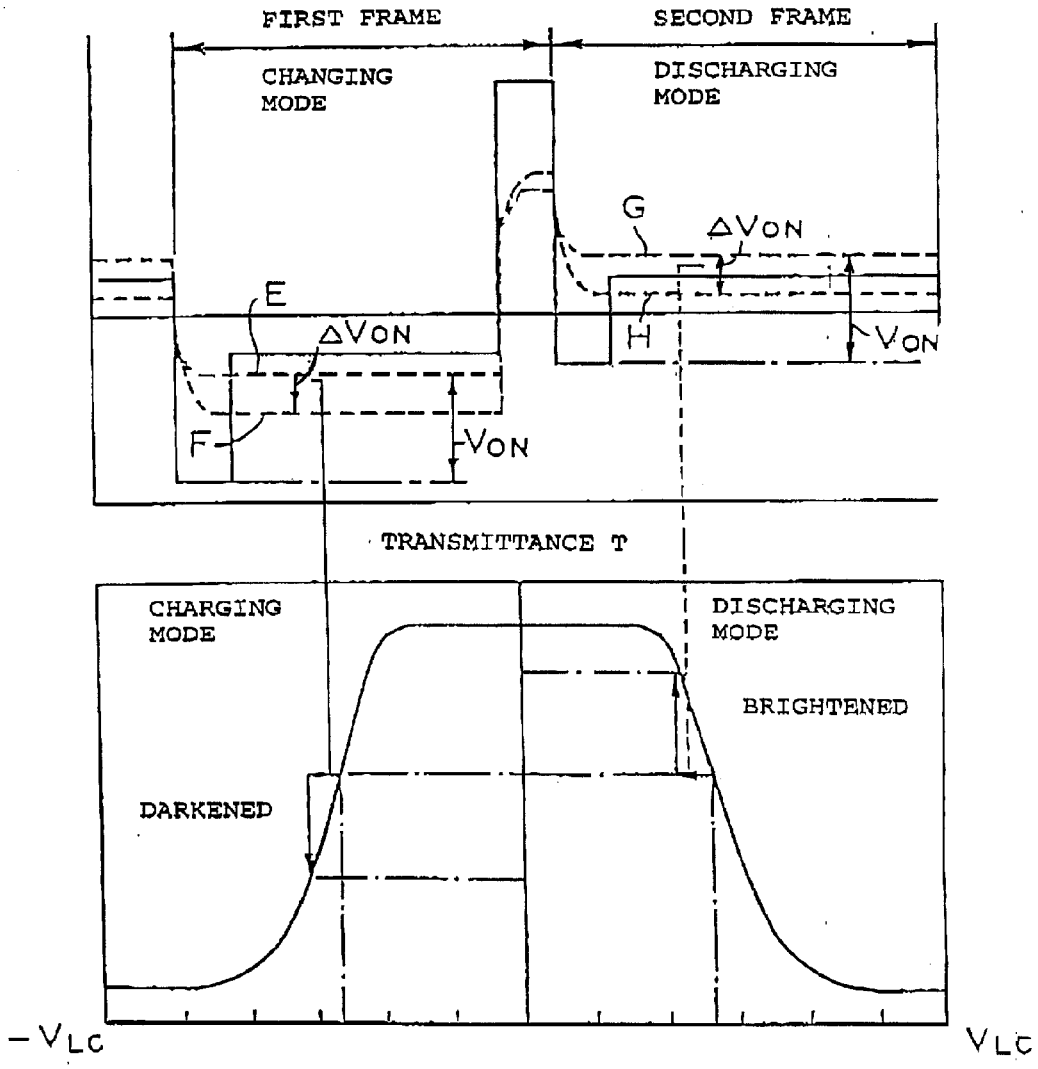

If an error occurs in $V_{ON}$. for example, if the $V_{ON}$ becomes larger by $\Delta V_{ON}$ as shown in FIG. 3(B), an error is also caused in $V_{A1}$ and $V_{A2}$, such that, as is apparent from the above equations (1) and (2), the absolute value of each of $V_{A1}$ and $V_{A2}$ decreases by $\Delta V_{ON}$. On the other hand, if the $V_{ON}$ becomes smaller by $\Delta V_{ON}$, the absolute value of each of $V_{A1}$ and $V_{A2}$ increases by $\Delta V_{ON}$. If an error $\Delta K$ occurs in K, an error not negligibly small is caused in $V_{A1}$ and $V_{A2}$.

On the other hand, the charge-discharge drive method has, as shown in FIG. 2, a charging mode (e.g., a first mode) in which a first selecting voltage $V_{S1}$ is supplied to the scanning line, and a discharging mode in which $-V_{PRE}$ which is a precharge voltage opposite in polarity to $V_{S1}$ is supplied and a second selecting voltage $V_{S2}$ opposite in polarity to $-V_{PRE}$ is thereafter supplied. A voltage $V_{B1}$ ($V_{LC}$ at time $t_1$) applied to the liquid crystal element immediately after the end of the selecting period is the same as that shown above by equation (1). That is, $$V_{B1}=(V_{S1}+V_H-V_{ON})=K\cdot V_{S1} \quad (3)$$

On the other hand, in the discharging mode, after overcharging by the precharge voltage $-V_{PRE}$ the electric charge is discharged by the second selecting voltage $V_{S2}$, and a voltage applied to the liquid crystal element immediately before the selecting period is $V_{S2}-V_{ON}$. Therefore, a voltage $V_{B2}$ ($V_{LC}$ at time $t_2$) applied to the liquid crystal element immediately after the end of the selecting period is $$V_{B2}=-[(V_{ON}+V_{S2})+K\cdot(V_{S2}+V_H)] \quad (4)$$

As is apparent from the above equations (3) and (4), if, for example, $V_{ON}$ becomes larger by $\Delta V_{ON}$, the absolute value of $V_{B1}$ becomes smaller by $\Delta V_{ON}$ and, conversely, the absolute value of $V_{B2}$ becomes larger by $\Delta V_{ON}$. Further, if an error $\Delta K$ occurs in K and if the absolute value of $V_{B1}$ becomes larger by this error, the absolute value of $V_{B2}$ becomes smaller. If the absolute value of $V_{B1}$ becomes smaller by this error, the absolute value of $VB_2$ becomes larger.

Figure 4:
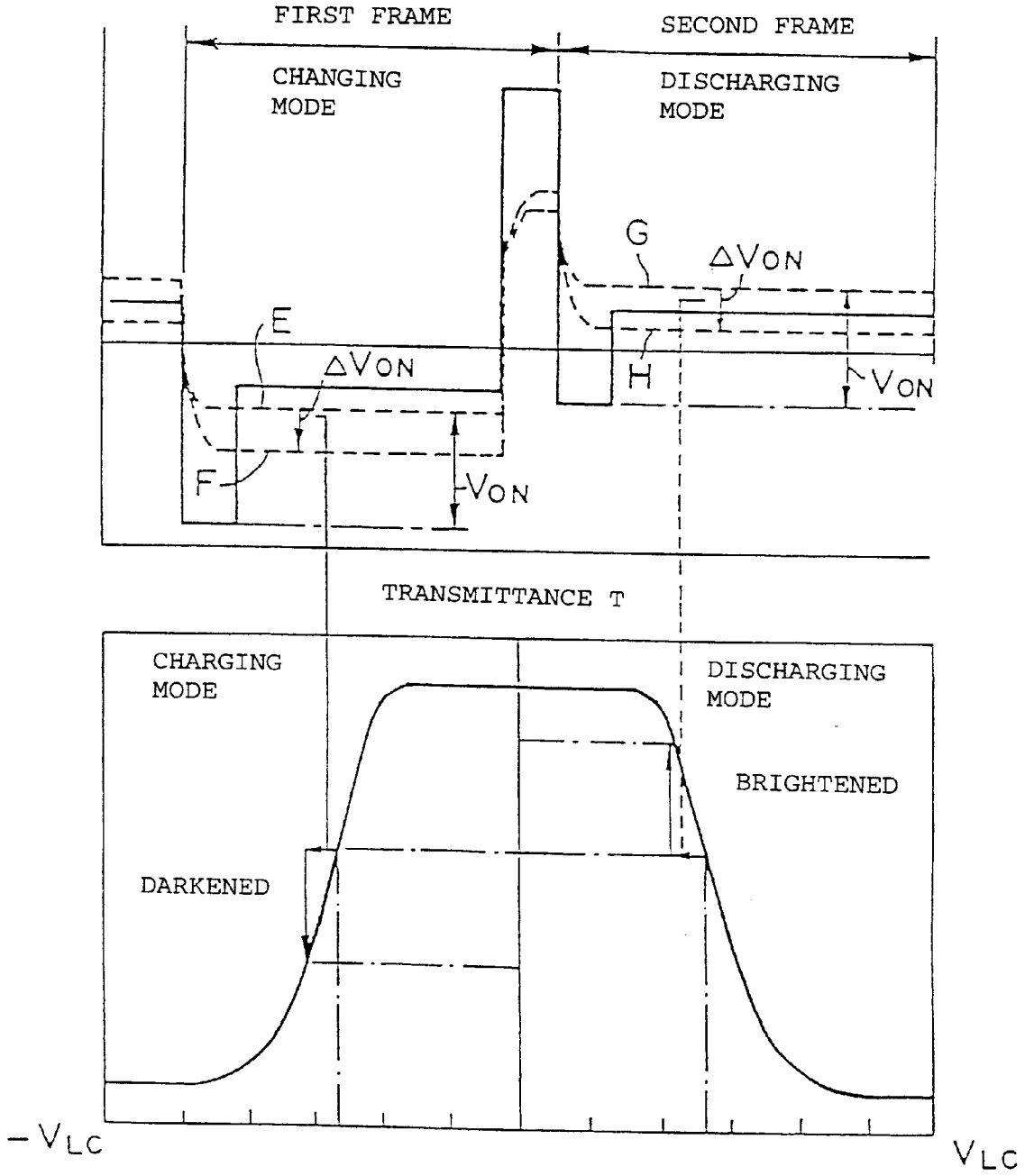
FIG. 4 is a diagram for explaining an improvement in display characteristic achieved by the charge-discharge drive method.
Figure 5:
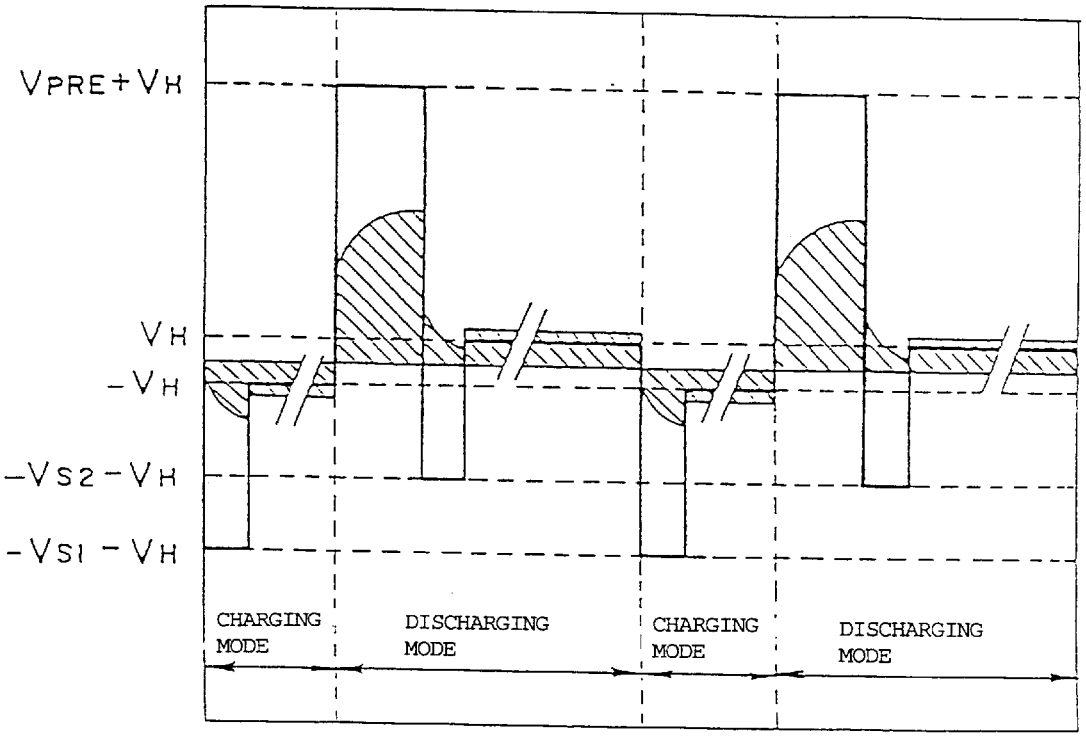
FIGS. 5(A) and 5(B) are diagrams showing other examples of the drive waveforms of the charge-discharge drive method.
Figure 5:
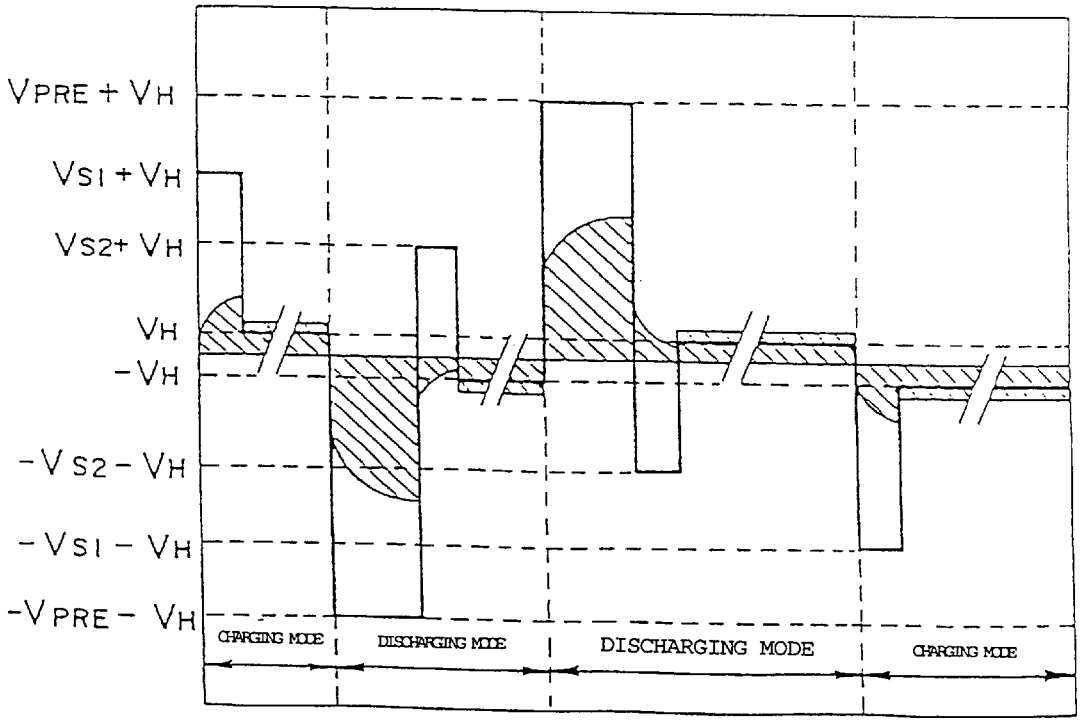

According to the charge-discharge drive method, as described above, even if $V_{ON}$ of the MIM element varies, an error voltage caused in the liquid crystal (pixel electrode) applied voltage in the charging mode can be canceled out, in terms of effective voltage, by an error voltage caused in the liquid crystal applied voltage in the charging mode. Consequently, it is possible to effectively prevent occurrence of a display nonuniformity or the like due to a variation in $V_{ON}$ of the MIM elements in the liquid crystal panel. FIG. 4 schematically illustrates the above-described effect. Error $\Delta V_{ON}$ occurs in $V_{ON}$, the absolute value of the liquid crystal applied voltage in the charging mode increases from E to F of FIG. 4, and the effective voltage applied to the liquid crystal element also increases. The transmittance of the liquid crystal element is thereby reduced, so that the display becomes lower in brightness (in the case of normally white display). However, the absolute value of the liquid crystal applied voltage then decreases from G to H of FIG. 4 in the discharging mode, and the effective voltage applied to the liquid crystal element also decreases. The transmittance of the liquid crystal element is thereby increased, so that the display becomes brighter. As a result, the total brightness of the display on one pixel is not substantially changed. Consequently, even if $V_{ON}$ of the MIM elements varies in the liquid crystal panel, substantially no variation occurs in the brightness of the display, thus preventing a display nonuniformity or the like. According to the charge-discharge drive method, even if a variation in $K=C_M/(C_M+C_L)$ occurs, a display nonuniformity can be prevented in the same manner.

Figure 5A:
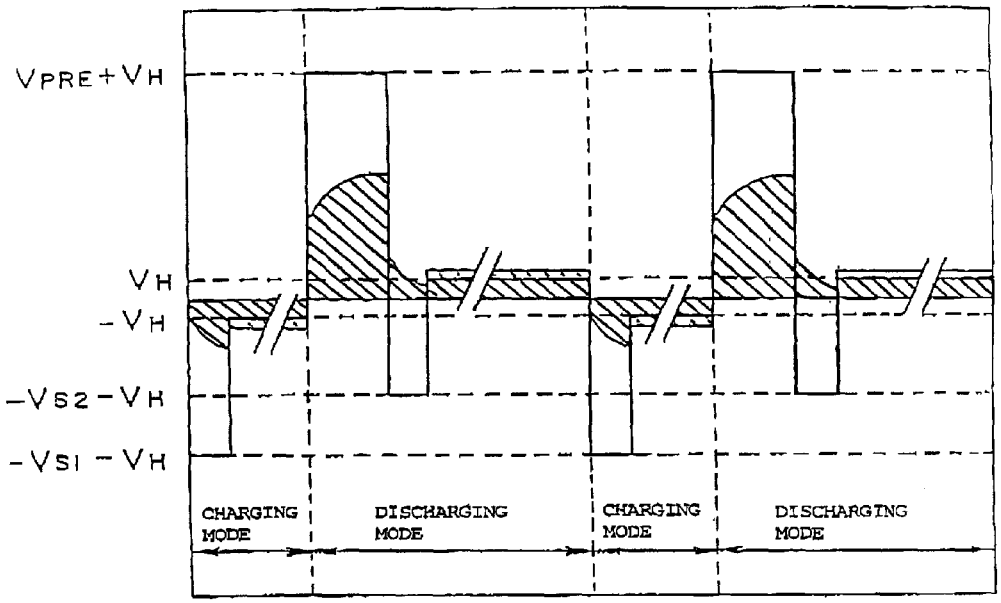
Figure 5B:
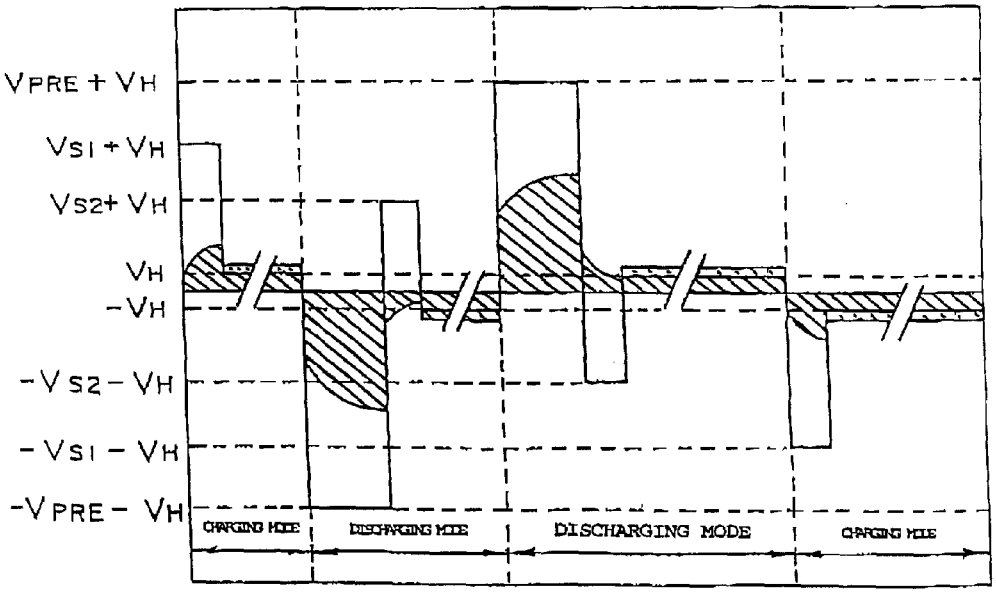
Figure 6:
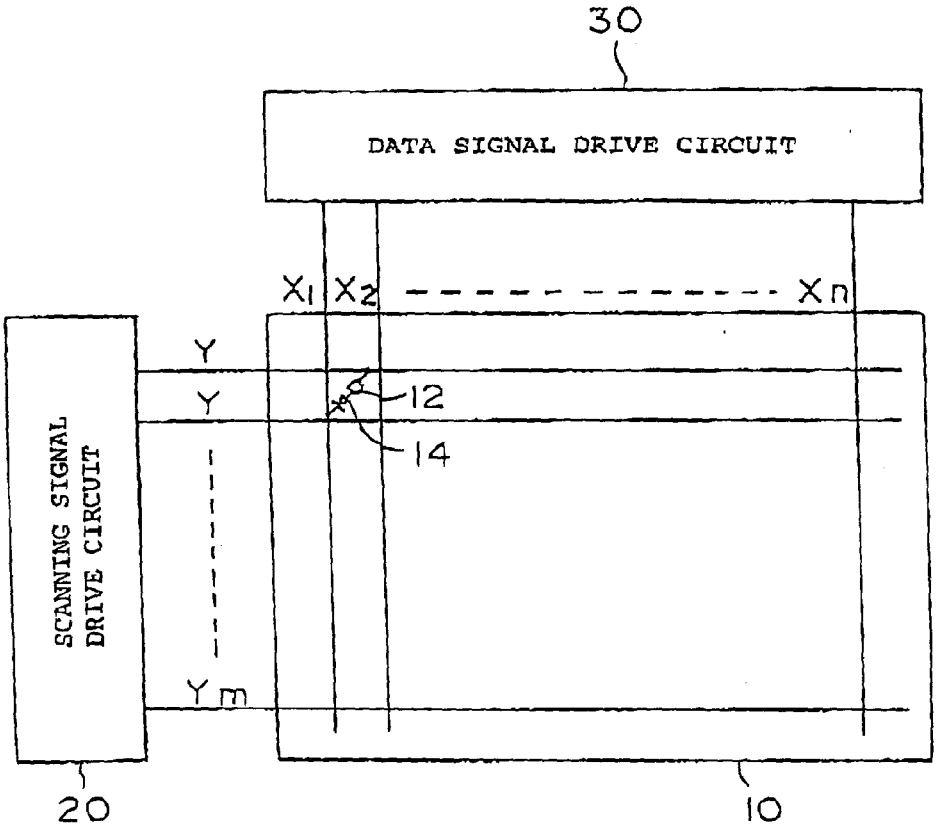

The drive waveforms of the charge-discharge drive method are not limited to those shown in FIG. 2. Some modifications of the drive waveforms are conceivable. For example, positive precharging may be performed as shown in FIGS. 4 and 5(A), and precharging both with positive and negative polarities may be performed as shown in FIG. 5(B).

The first embodiment will now be described in detail.

Figure 6:
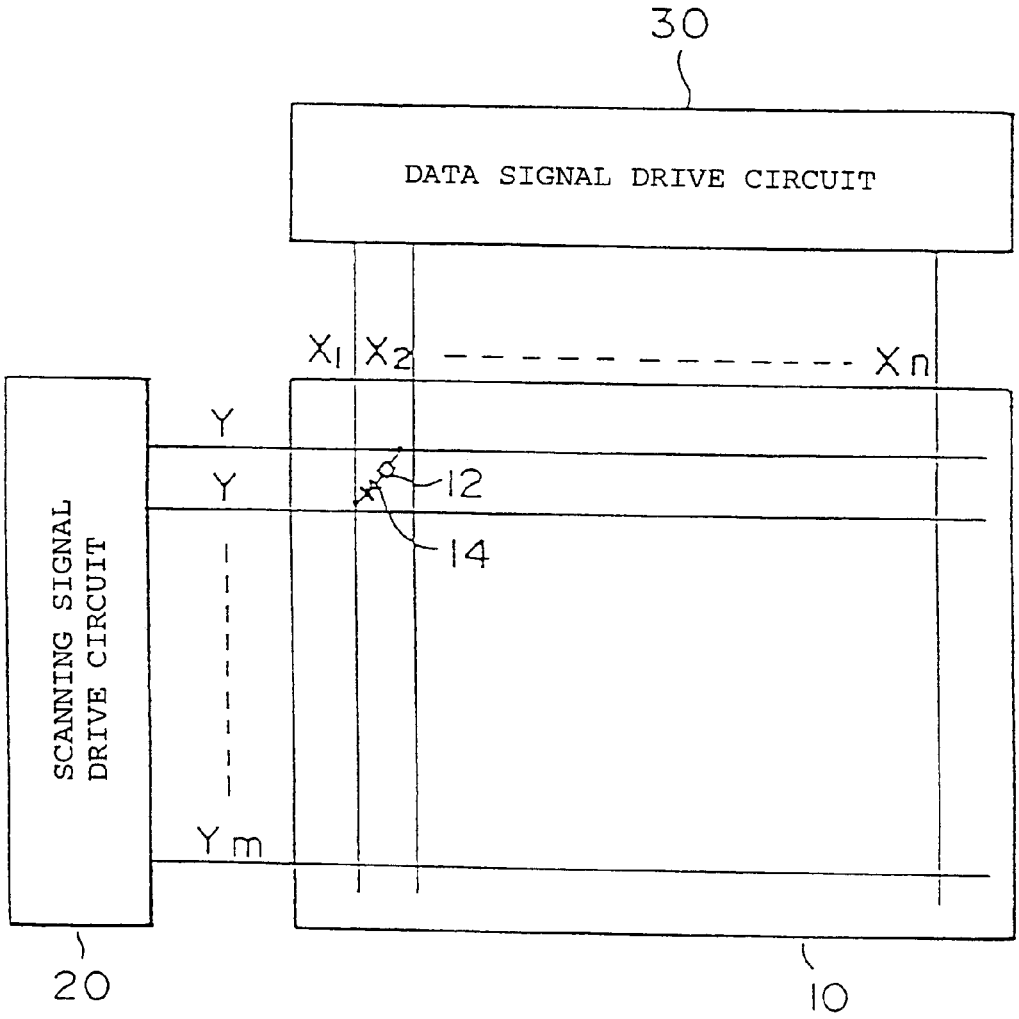
FIG. 6 is a block diagram common to a first embodiment and a second embodiment.
Figure 7:
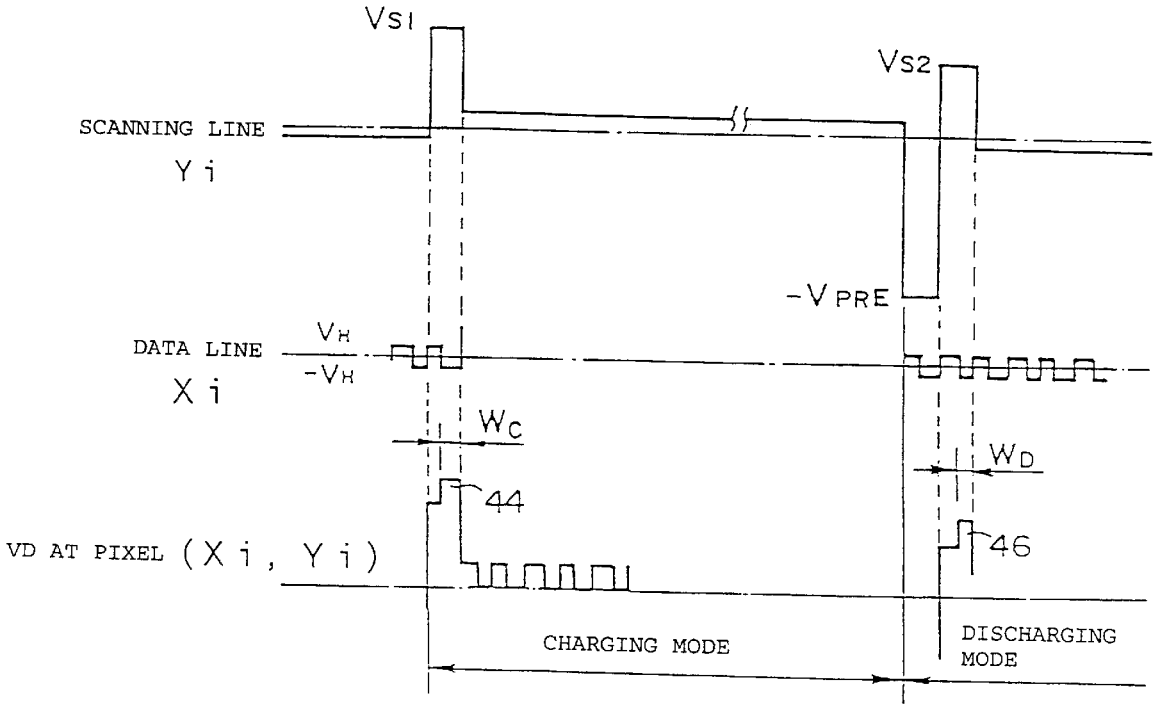
FIGS. 7(A) and 7(B) are diagrams for explaining the principle of the first embodiment.
Figure 7:
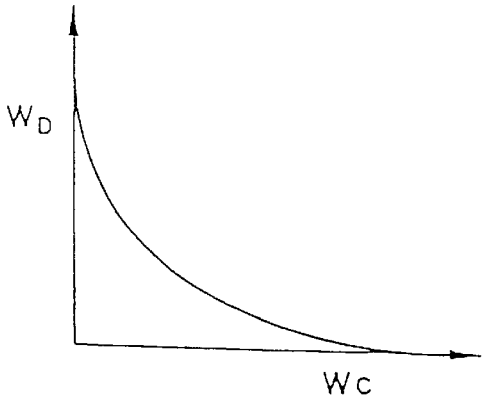
Figure 8:
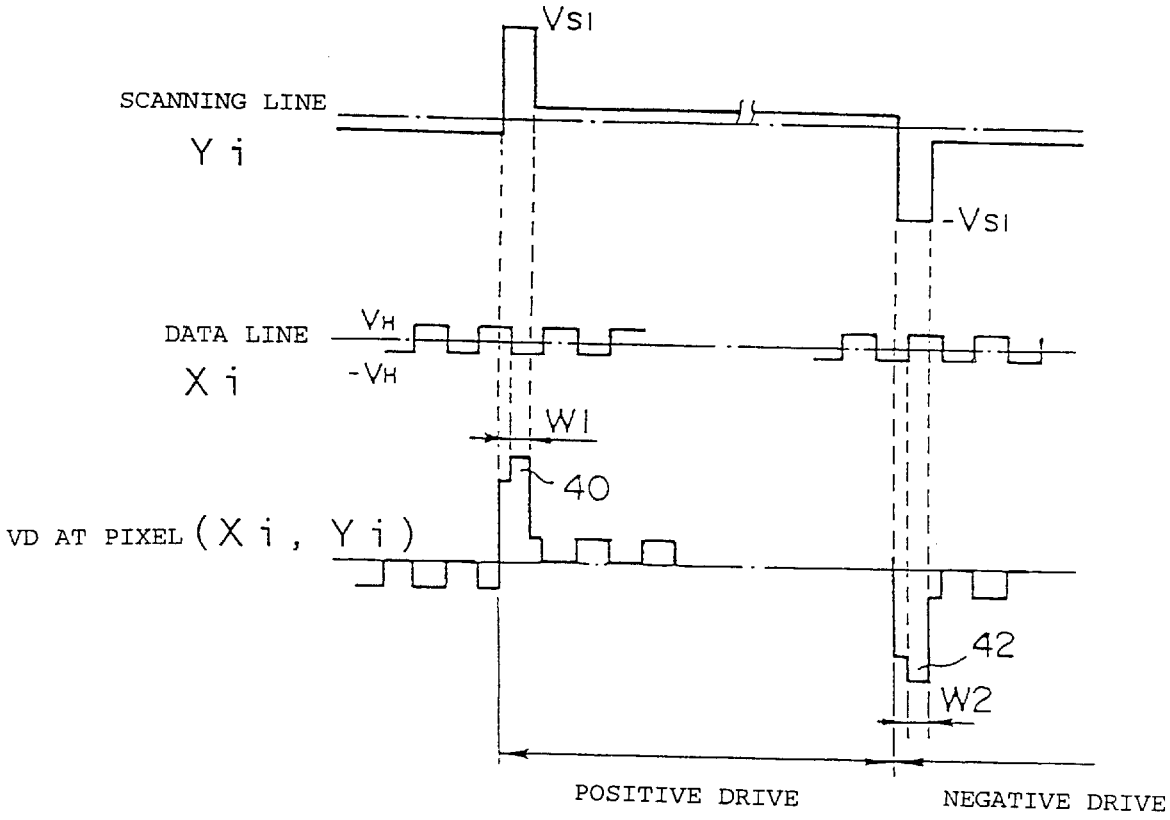
FIGS. 8(A) and 8(B) are diagrams for explaining pulse width modulation based on the four-value drive method.
Figure 8:
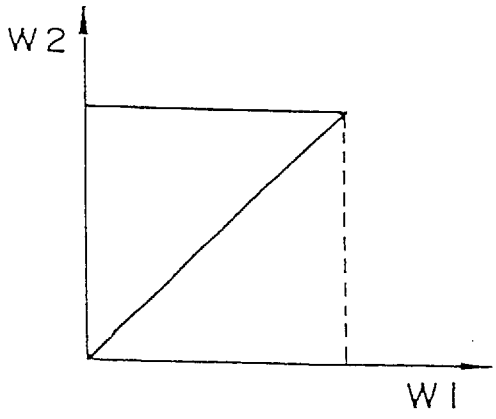
Figure 7A:
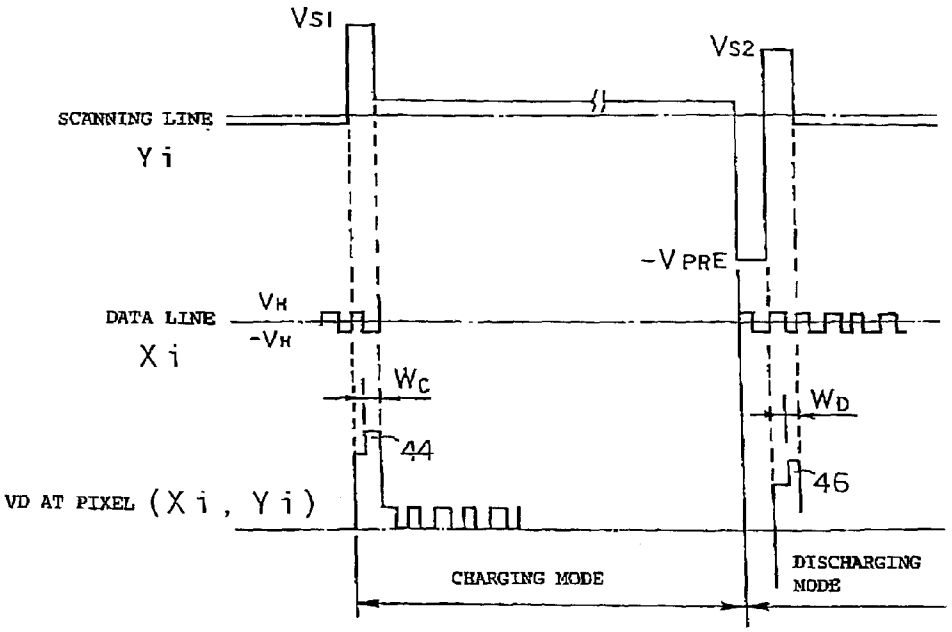

FIG. 6 is a block diagram of the first embodiment, which is a block diagram used in common in the following description of the present invention. FIG. 7(A) shows an example of drive waveforms for explanation of the principle of the present invention. A liquid crystal panel 10 has a plurality of data lines X1 to Xn and a plurality of scanning lines Y1 to Yn. MIM elements 12 and liquid crystal elements 14 are electrically connected between the data lines and the scanning lines a shown in FIG. 6, for example. A scanning signal drive circuit 20 supplies the first selecting voltage $V_{S1}$ to one of the scanning lines as shown in FIG. 7(A) in the charging mode (e.g., a first mode). In the discharging mode (e.g., a second mode), the scanning signal drive circuit 20 supplies the scanning line with $-V_{PRE}$, which is a precharge voltage opposite in polarity to the first selecting voltage $V_{S1}$ about a middle value of a data voltage applied to the data line, and thereafter supplies the scanning line with the second selecting voltage $V_{S2}$ opposite in polarity to $-V_{PRE}$ about the middle value of the data voltage applied to the data line. On the other hand, a data signal drive circuit 30 supplies the pulse-width-modulated data voltage to the data line. In the above-described manner, grayshade display using the charge-discharge drive method and using pulse width modulation is performed.

Figure 8A:
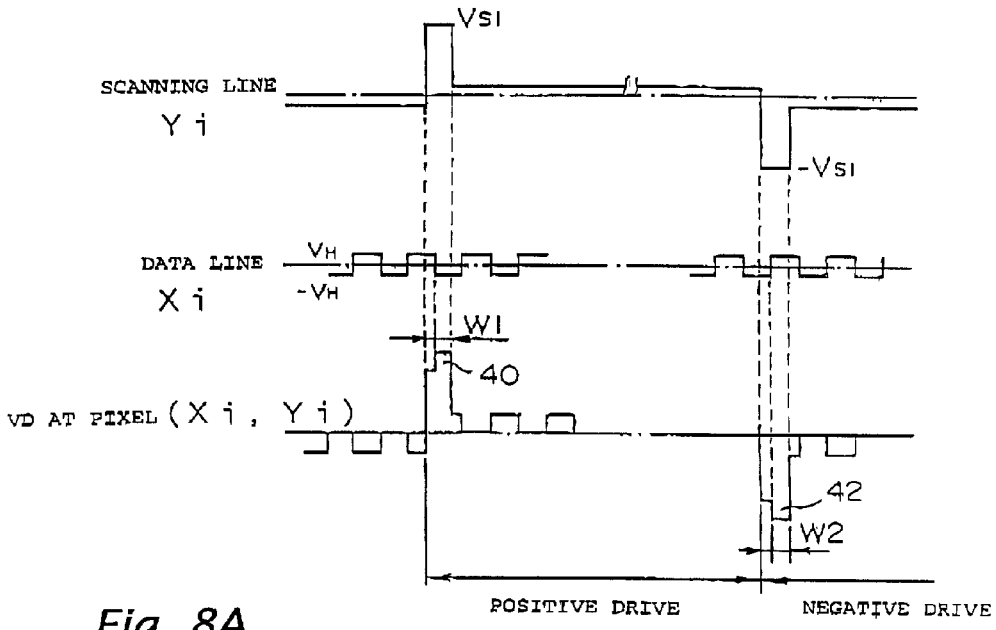
Figure 8B:
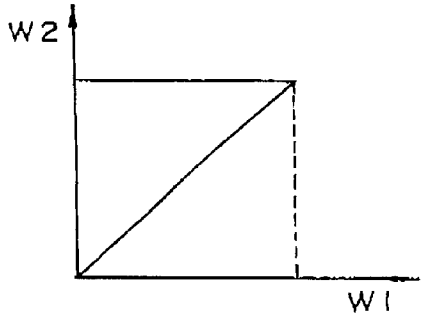
Figure 9:
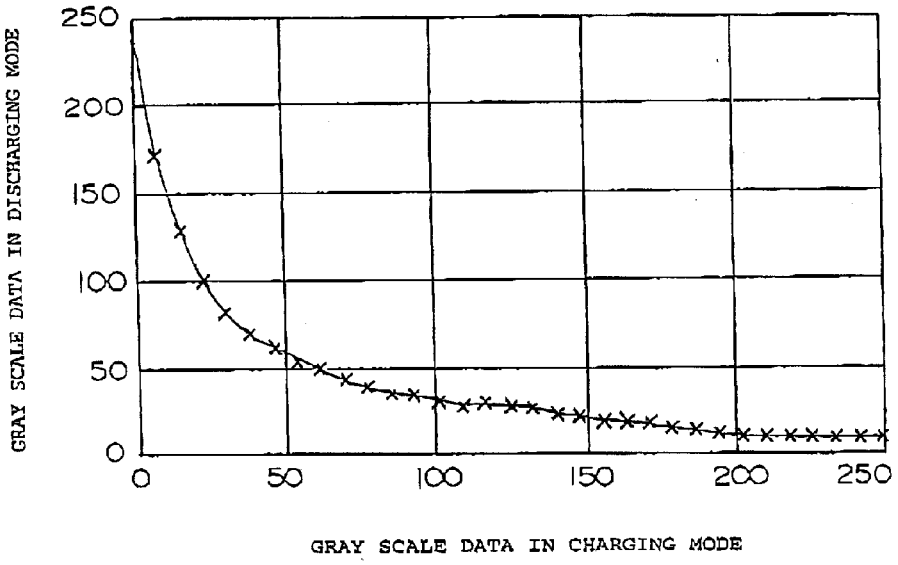
Figure 10:
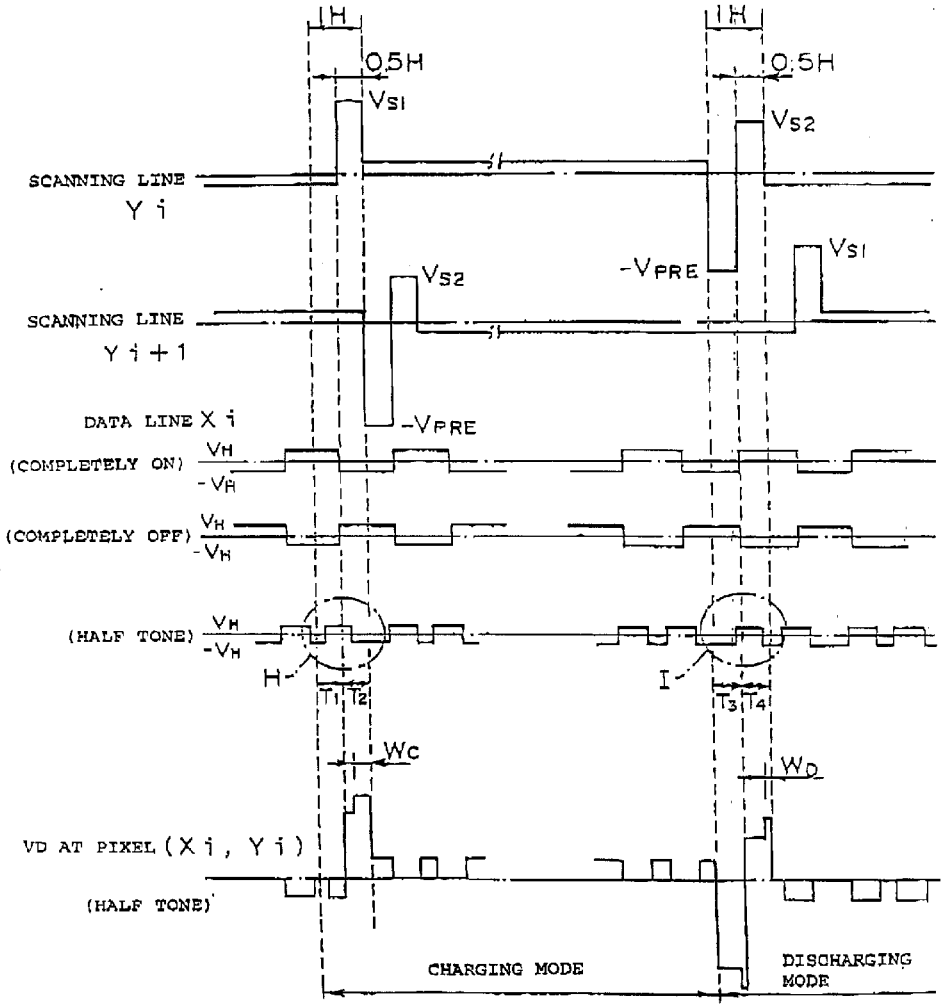

FIGS. 8(A) and 8(B) show an example of drive waveforms in a case where pulse width modulation is performed with the conventional four-value drive method. In the method of driving a liquid crystal display device, positive drive by supplying a positive voltage and negative drive by supplying a negative voltage are alternately performed with respect to frames in order to prevent application of a DC component to each liquid crystal element over a long time period. In such driving, according to the conventional four-value drive method, if the pulse widths of write pulses 40 and 42 setting the same gray scale value by positive and negative drives are W1 and W2, the pulse widths W1 and W2 are equal to each other as shown in FIGS. 8(A) and 8(B).

Figure 7B:
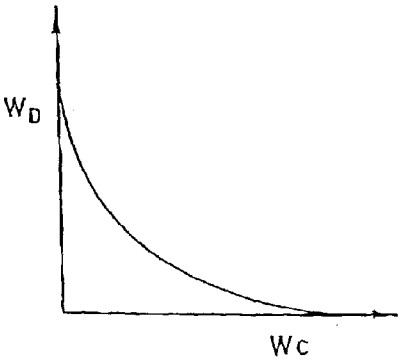

In contrast, in the first embodiment shown in FIG. 7(A), if the pulse widths of first and second write pulses 44 and 46 which are formed by the first and second selecting voltages $V_{S1}$ and $V_{S2}$ in the charging and discharging modes and which set the same gray scale value are $W_C$ and $W_D$, the pulse widths $W_C$ and $W_D$ are in the relationship shown in FIG. 7(B). That is, $W_D$ decreases as $W_C$ increases, and the rate at which $W_D$ decreases becomes lower as $W_C$ increases. In other words, $W_C$ decreases as $W_D$ increases, and the rate at which $W_C$ decreases becomes lower as $W_D$ increases. If the pulse width is set in this manner, suitable grayshade display by pulse width modulation is also possible in the charge-discharge drive method while application of a DC voltage to each liquid crystal element over a long time period can be prevented. If the conception of the pulse width modulation in the conventional four-value drive method is directly applied, $W_C$ and $W_D$ are made equal to each other. In the first embodiment, however, that conception is not applied and, specifically, pulse width setting is performed in such a manner that, when one of $W_C$ and $W_D$ is increased, the other is reduced. Further, the first embodiment has been made upon knowing that not only reducing the other but also reducing the rate of this reduction is required to enable suitable grayshade display. The first embodiment is characterized mainly by this conception.

In the case of grayshade display using pulse height modulation in a charge-discharge drive method, e.g., that disclosed in Japanese Patent Laid-Open No. 125225/1990, there is the problem of difficulty in performing voltage control for obtaining the desired gray scale, which results in a high cost of a liquid crystal display device. This problem, however, can be solved according to the first embodiment.

Figure 9:
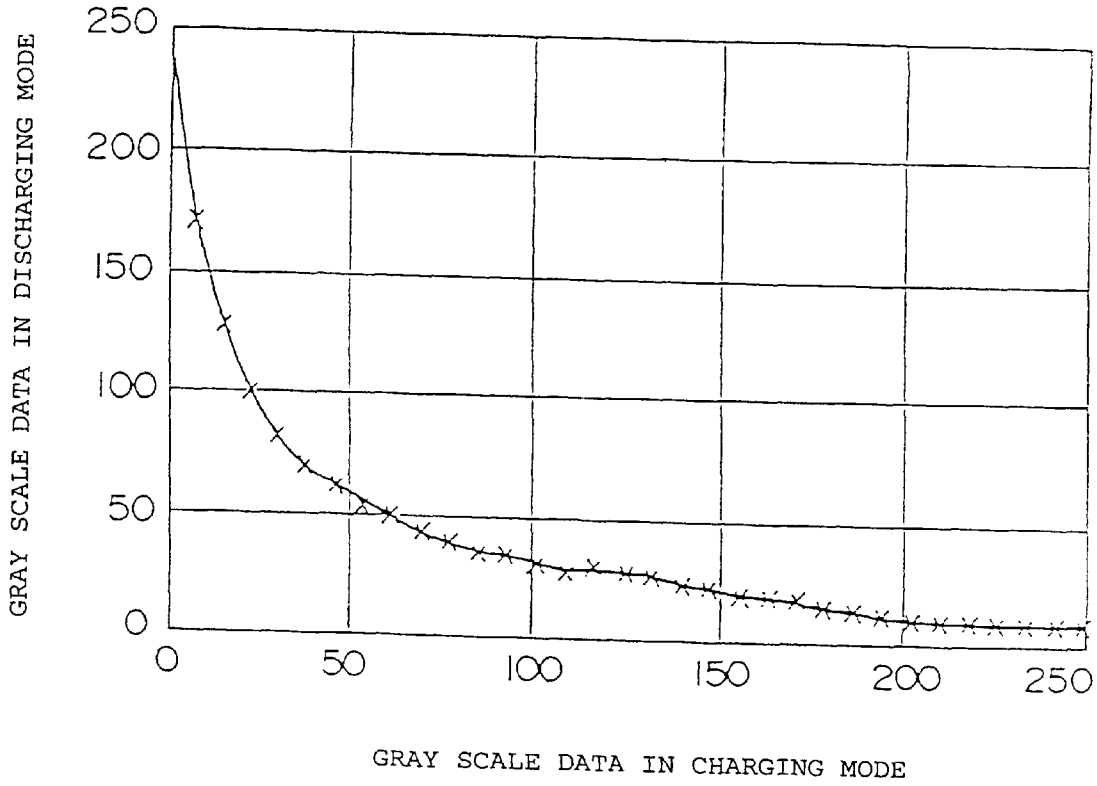
FIG. 9 is a diagram showing the result of a measurement of the relationship between gray scale data in a charging mode and gray scale data in a discharging mode.

FIG. 9 shows the result of a measurement of the relationship between gray scale data in the charging mode and gray scale data in the discharging mode. For this measurement, gray scale data in the charging mode, for example, is first changed. Thereafter, gray scale data in the discharging mode is changed so that the liquid crystal (pixel electrode) applied voltages ($V_{LC}$ at times $t_1$ and $t_2$ in FIG. 2) immediately after the periods of selecting by the first and second selecting voltages $V_{S1}$ and $V_{S2}$ are equal to each other. The relationship between the groups of gray scale data in the charging and discharging modes shown in FIG. 9 was obtained in this manner. The magnitude of this gray scale data corresponds to the pulse width of write pulses.

As can be understood from FIG. 9, if pulse widths $W_c$ and $W_D$ are set such that the liquid crystal applied voltages immediately after the periods of selecting with the first and second selecting voltages $V_{S1}$ and $V_{S2}$ (or at initial stages in the holding periods) are equal to each other, suitable grayshade display can be achieved and application of a DC voltage to each liquid crystal element over a long time period can be prevented.

(Second Embodiment)

Figure 10:
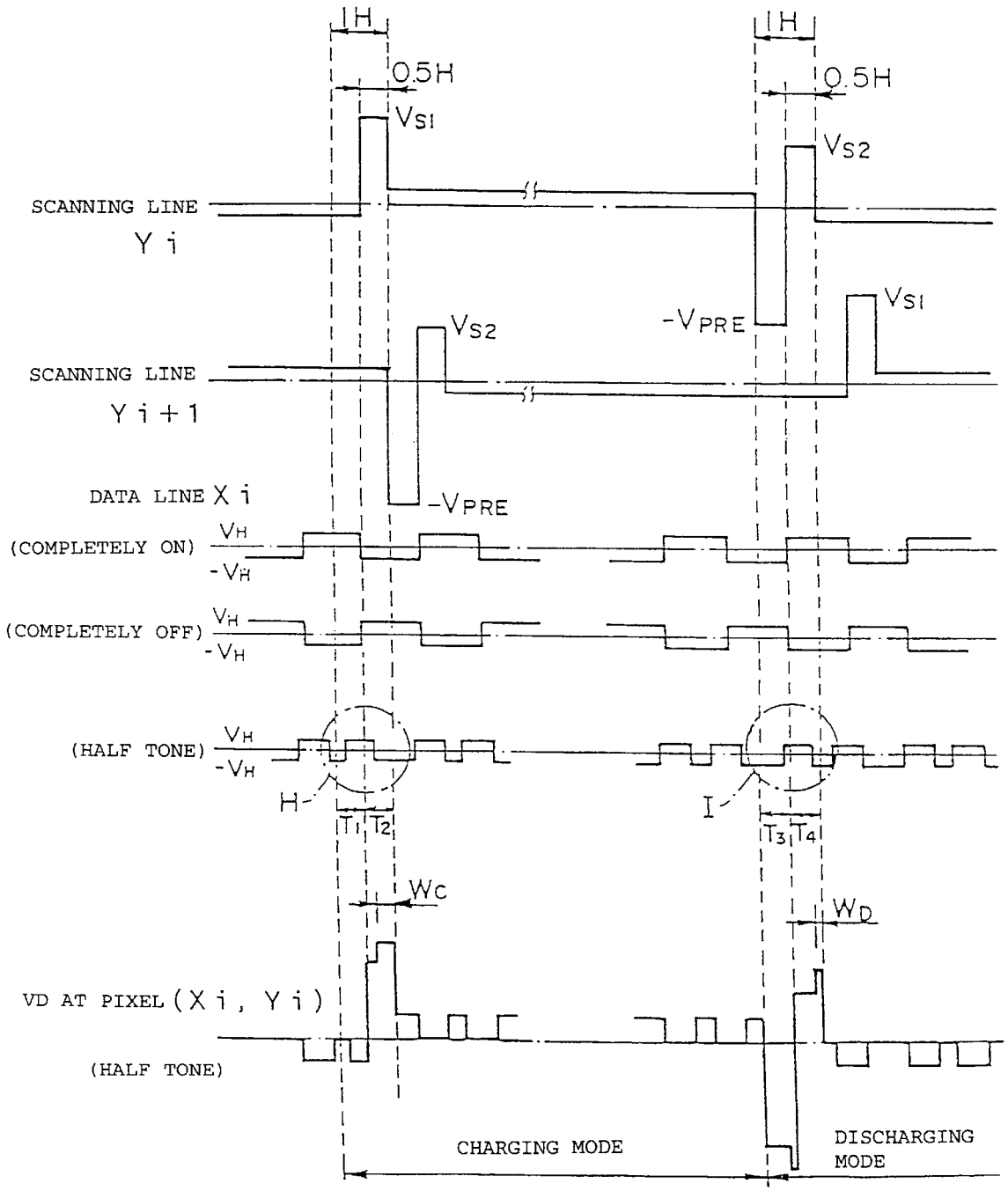
FIG. 10 is a diagram for explaining the principle of the second embodiment.
Figure 11:
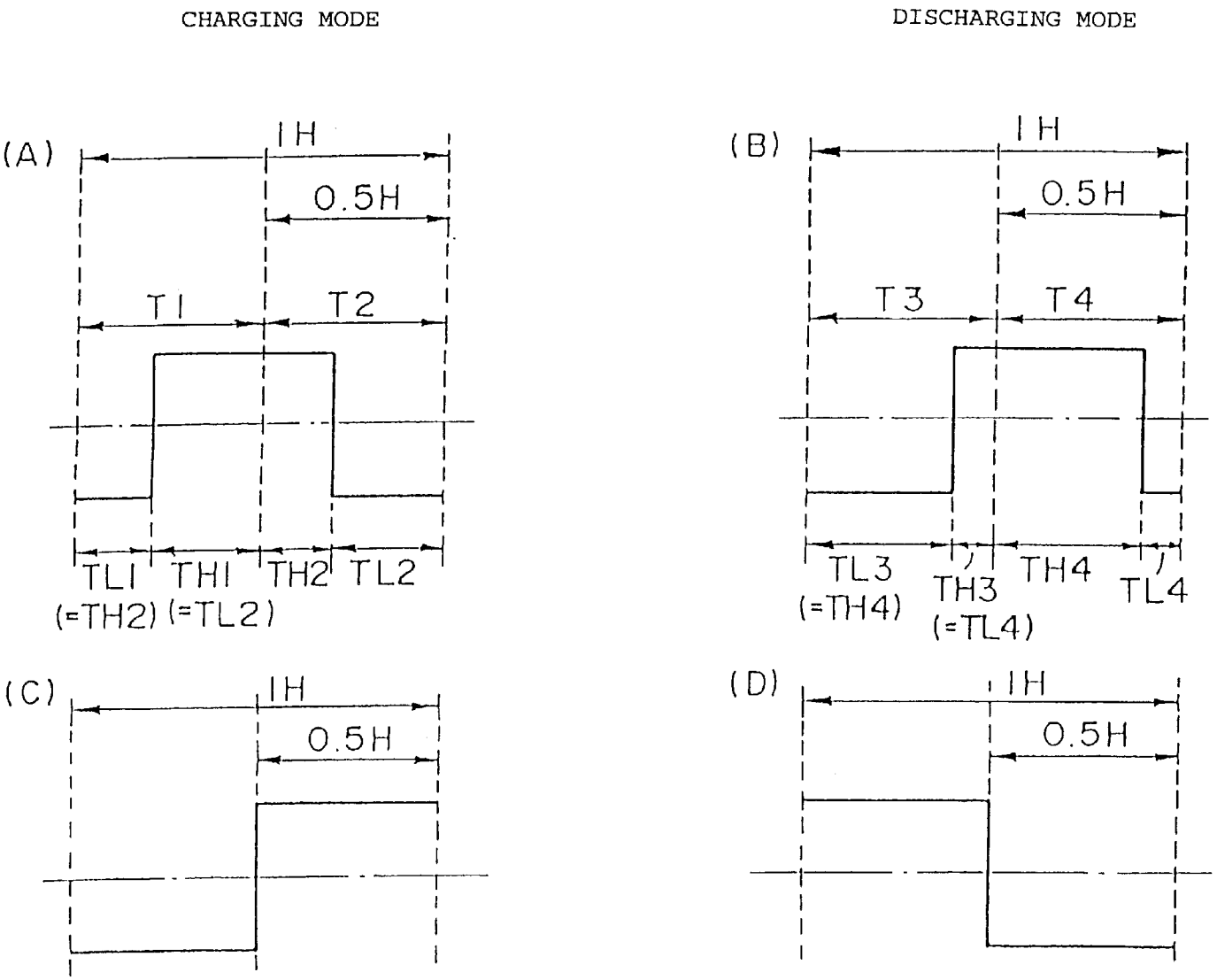
FIGS. 11(A), 11(B), 11(C), and 11(D) are diagrams for also explaining the principle of the second embodiment.
Figure 11A:
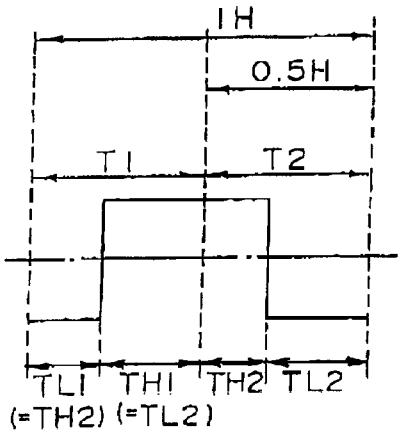
Figure 11B:
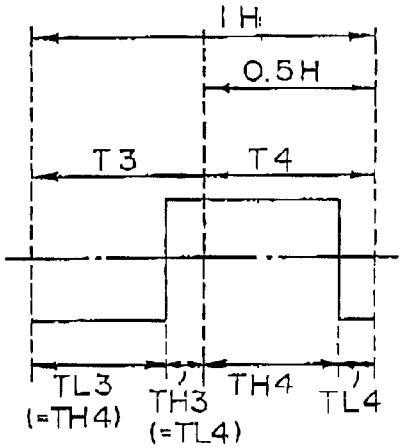

FIG. 10 shows an example of drive waveforms in the second embodiment, and FIGS. 11(A) and 11(B) show enlarged diagrams of portions H and I of FIG. 10.

In the second embodiment, in the charging mode, the scanning signal drive circuit 20 shown in FIG. 6 supplies the first selecting voltage $V_{S1}$ in a second period T2 following a first period $T_1$, which is the first-half period in a 1H period (one horizontal scanning period) (T1=T2=0.5H). In the discharging mode, the scanning signal drive circuit 20 supplies $-V_{PRE}$, which is a precharge voltage, in a third period T3, which is the first-half period of another IH period, and supplies the second selecting voltage $V_{S2}$ in a fourth period T4 following the third period T3 (T3=T4=0.5H).

In the charging mode, the data signal drive circuit 30 keeps the data voltage at a low level for the same period in the first period T1 as a period TH2 in the second period T2 through which the data voltage is at a high level (with respect to a middle voltage between the ON voltage and the OFF voltage). That is, the data signal drive circuit 30 keeps the data voltage at the low level for a period TL1 (=TH2). The data signal drive circuit 30 also keeps the data voltage at the high level for the same period in T1 as a period TL2 in T2 through which the data voltage is at the low level. That is, the data signal drive circuit 30 keeps the data voltage at the high level in a period TH1 (=TL2).

On the other hand, in the discharging mode, the data signal drive circuit 30 keeps the data voltage at the low level for the same period in the third period T3 as a period TH4 in the fourth period T4 through which the data voltage is at the high level. That is, the data signal drive circuit 30 keeps the data voltage at the low level for a period TL3 (=TH4). The data signal drive circuit 30 also keeps the data voltage at the high level for the same period in T3 as a period TL4 in T4 through which the data voltage is at the low level. That is, the data signal drive circuit 30 keeps the data voltage at the high level in a period TH3 (=TL4).

Figure 11C:
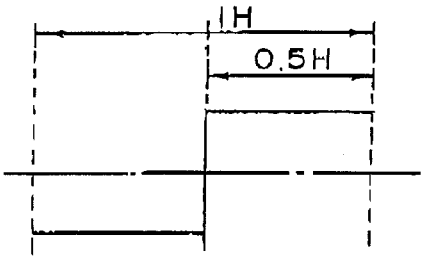
Figure 11D:
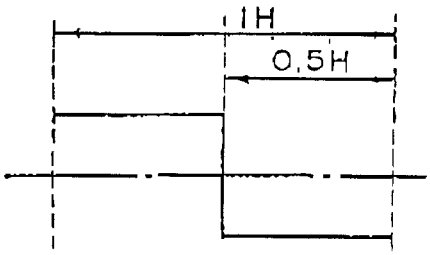

In the above-described manner, the DC component (with respect to the middle voltage between the ON voltage and the OFF voltage) of the data voltage supplied to each data signal line can be made approximately zero independent of the gray scale. That is, as shown in FIGS. 11(C) and 11(C), even if the data voltage is at the high or lower level through the entire selecting period H/2, the DC component of the data voltage through the 1H period can be made zero. Thus, the DC component of the data voltage through the 1H period is zero without being influenced by setting of the display gray scale. As a result, occurrence of a so-called vertical crosstalk can be effectively prevented.

Figure 12:
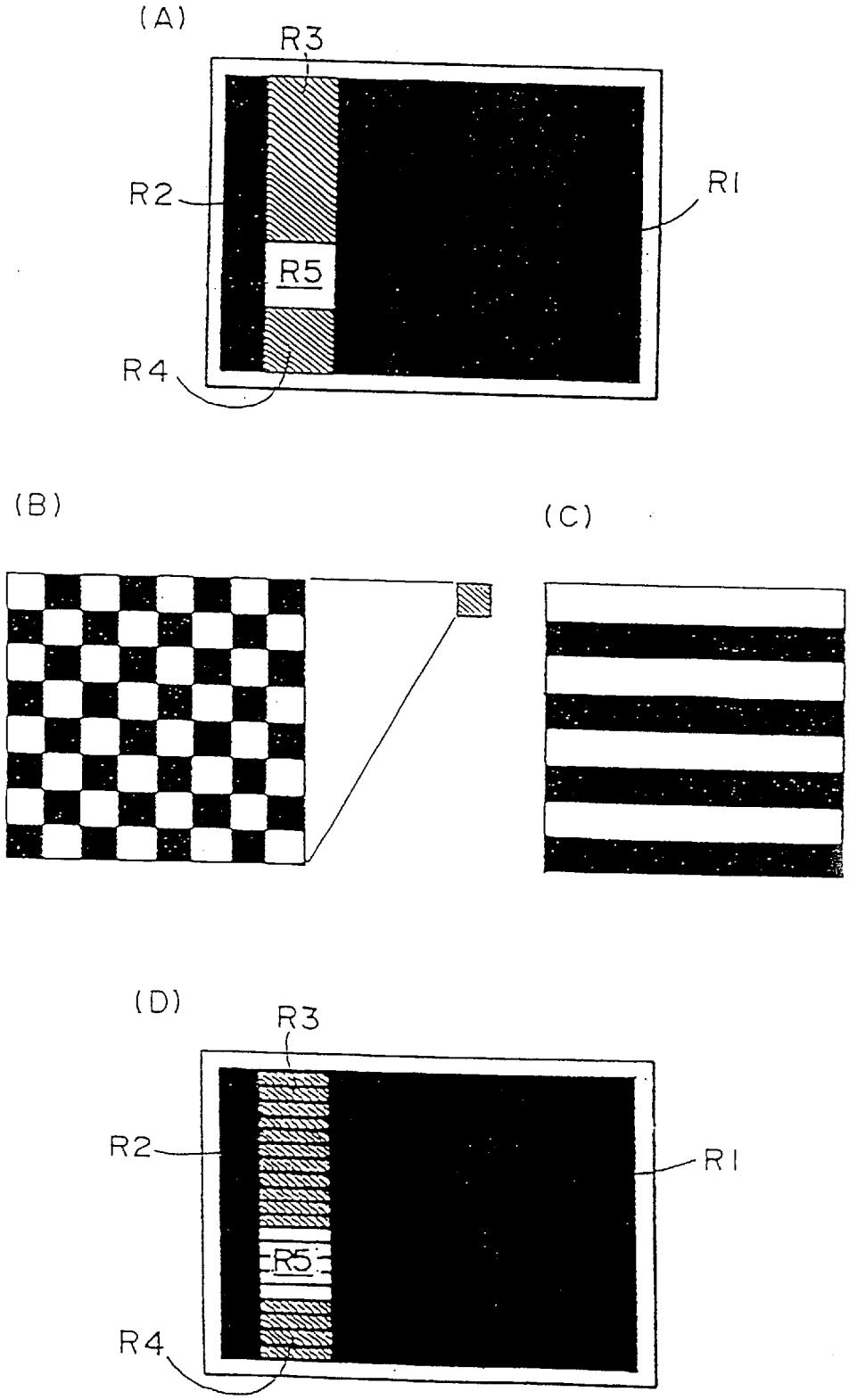
FIGS. 12(A), 12(B), 12(C), and 12(D) are diagrams for explaining a vertical crosstalk.
Figure 12A:
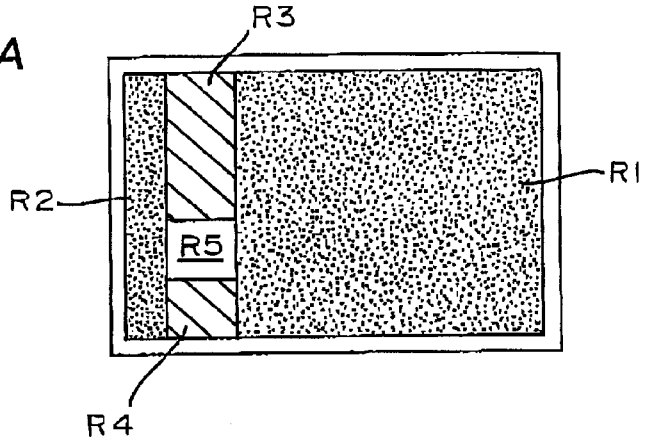
Figure 12B:
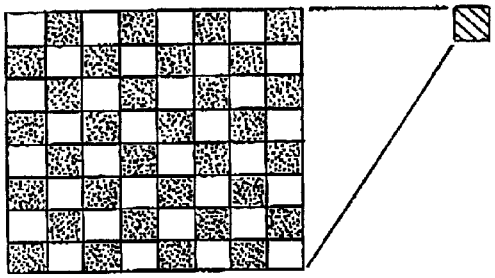
Figure 12C:
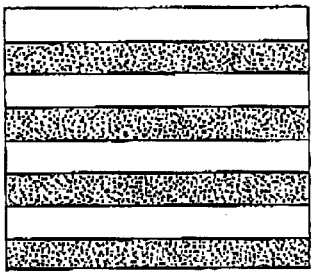
Figure 12D:
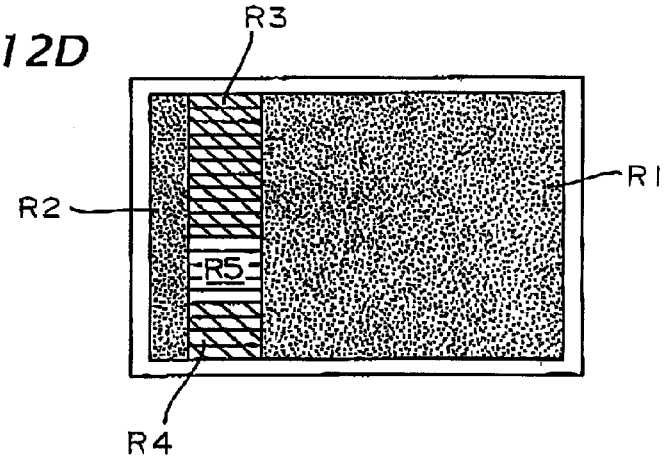
Figure 13:
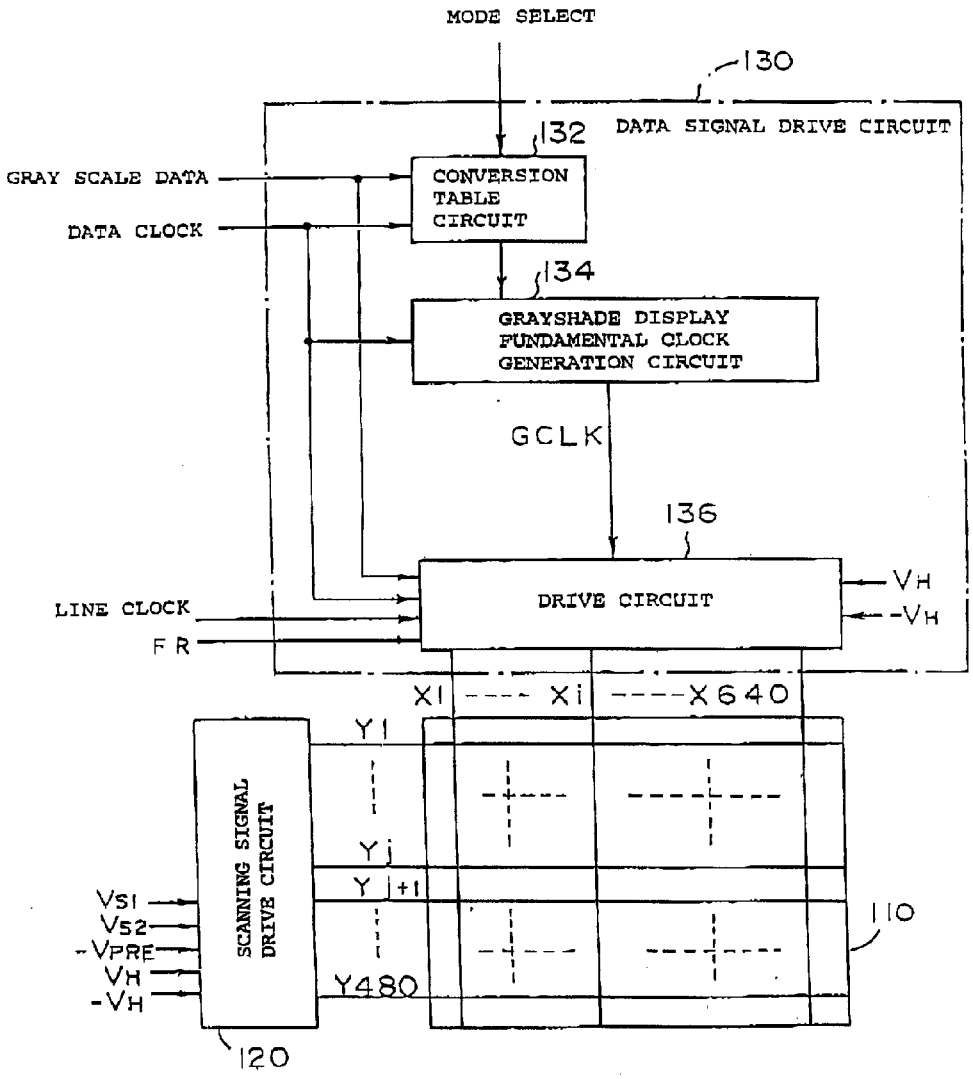
Figure 14:
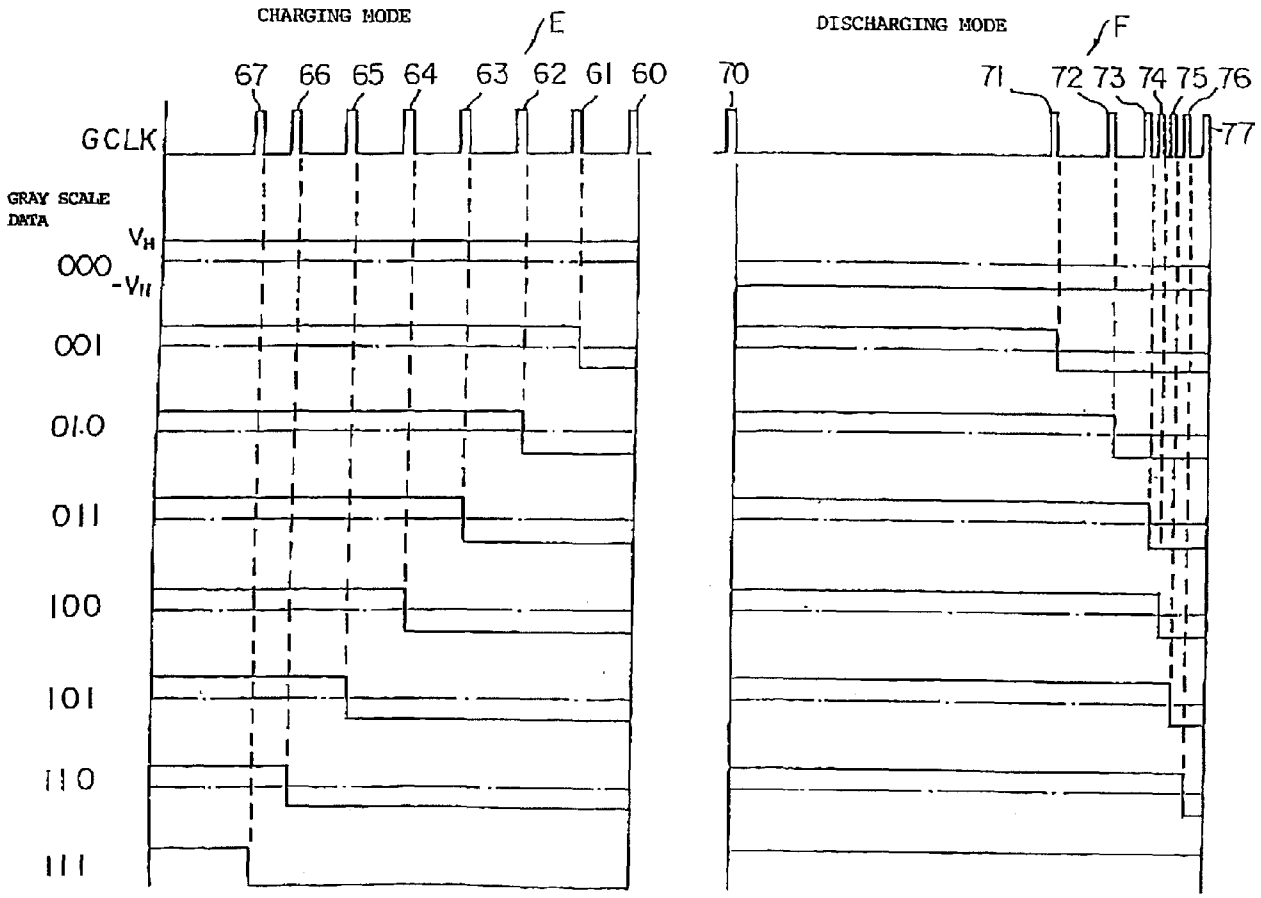
Figure 15:
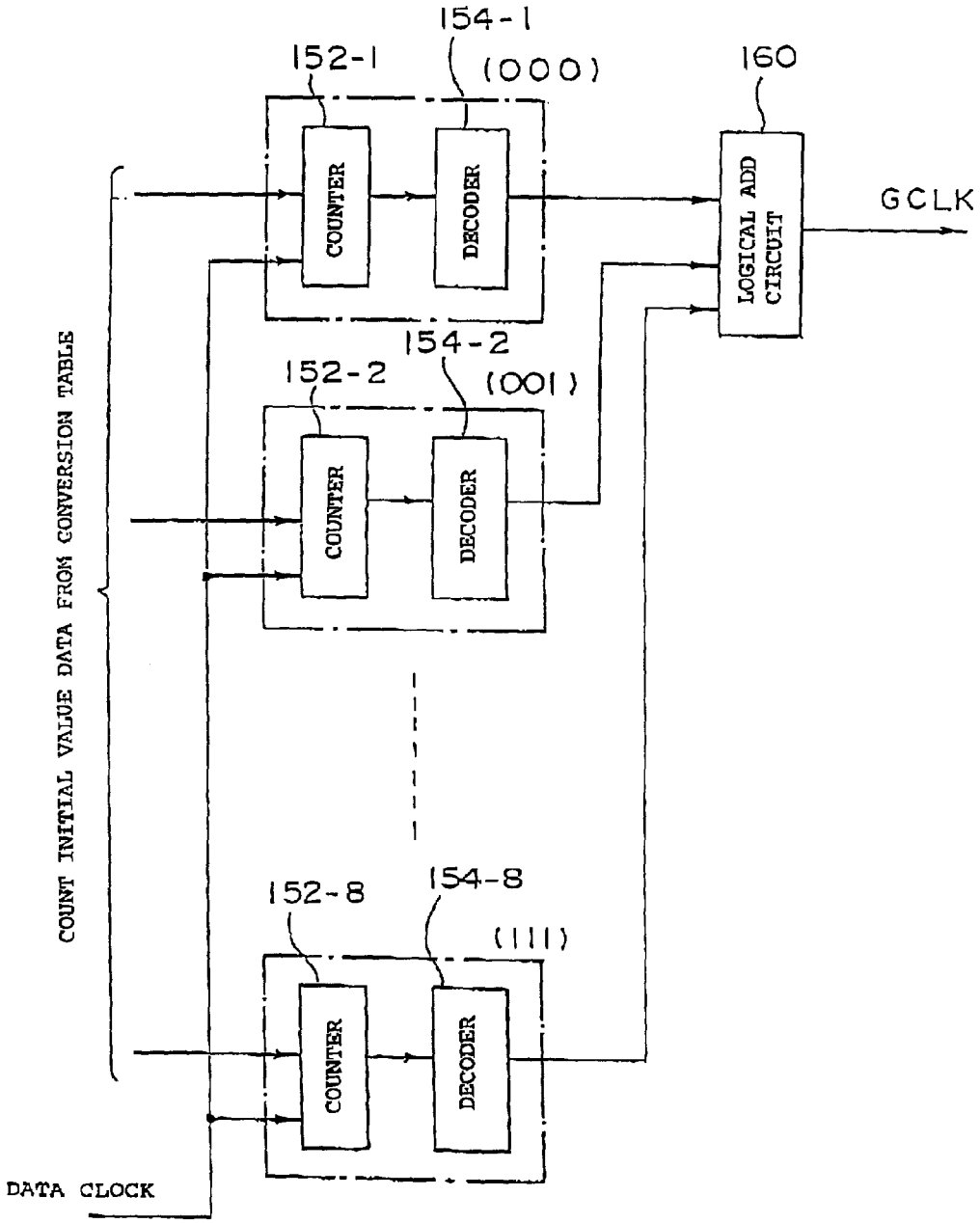
Figure 16:
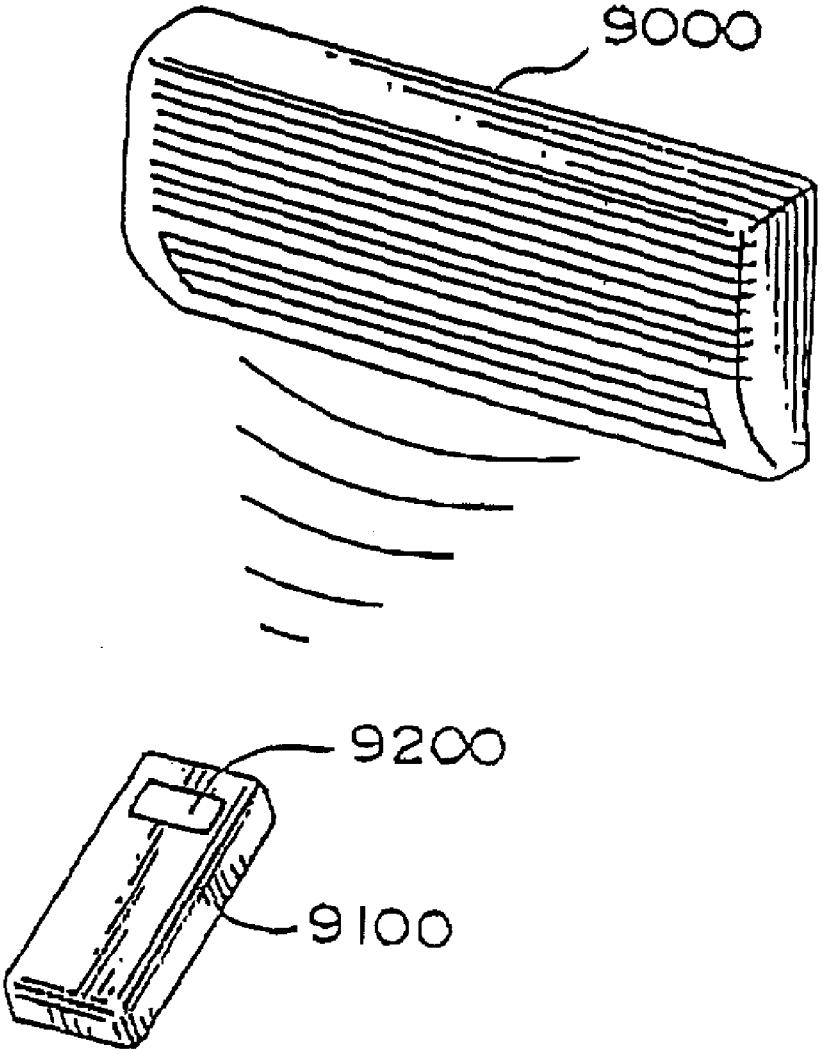
Figure 17:
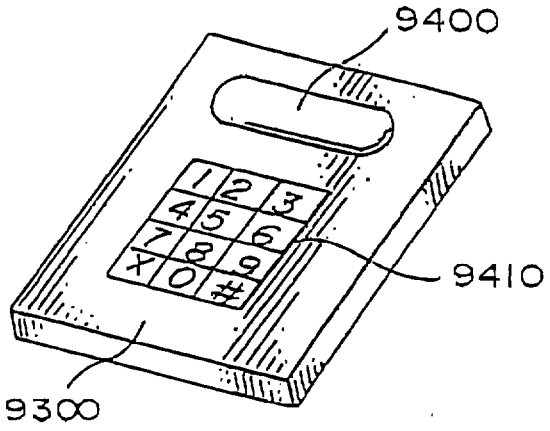
Figure 18:
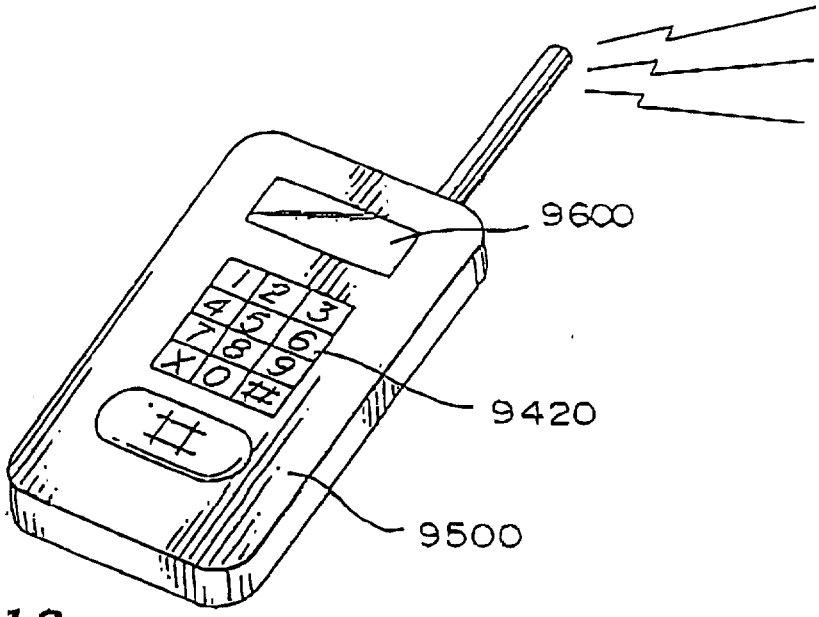
Figure 19:
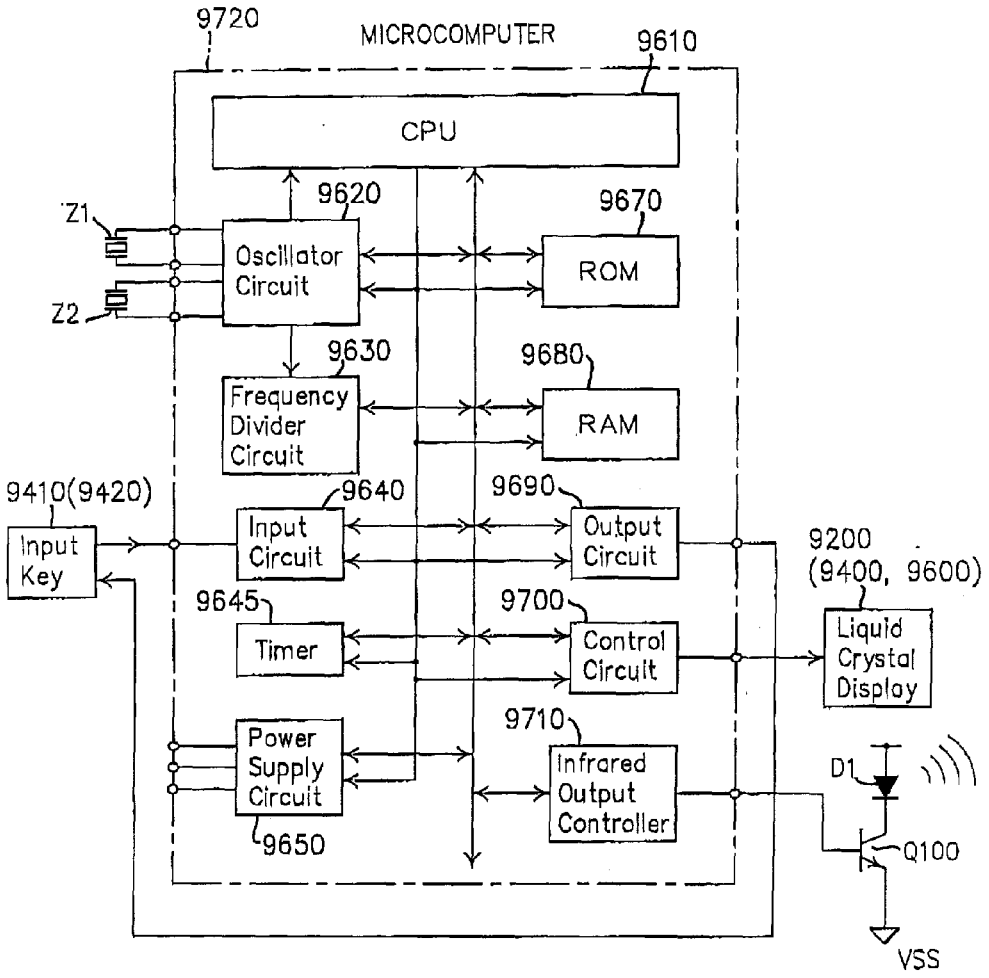
Figure 20:
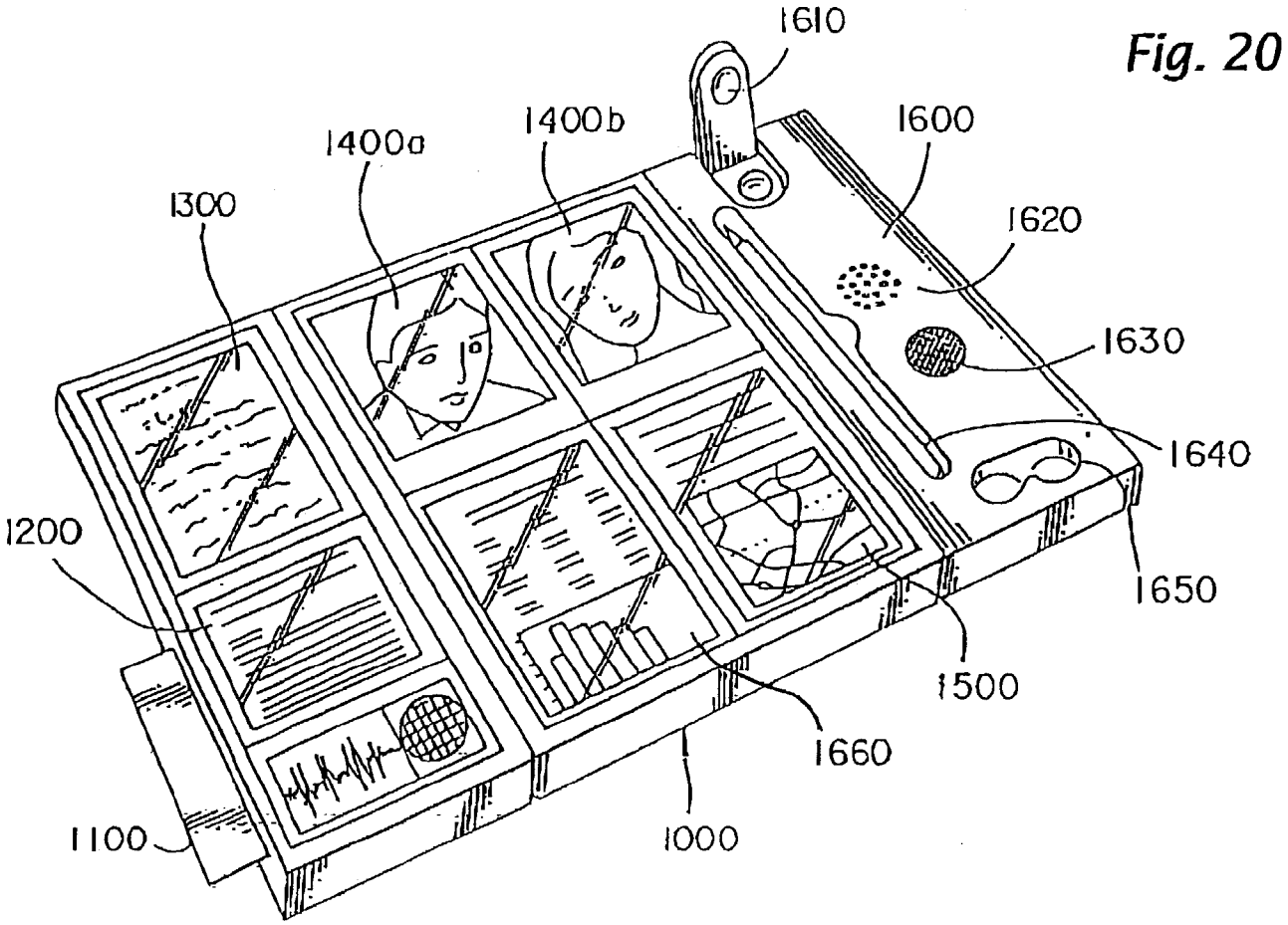
Figure 22:
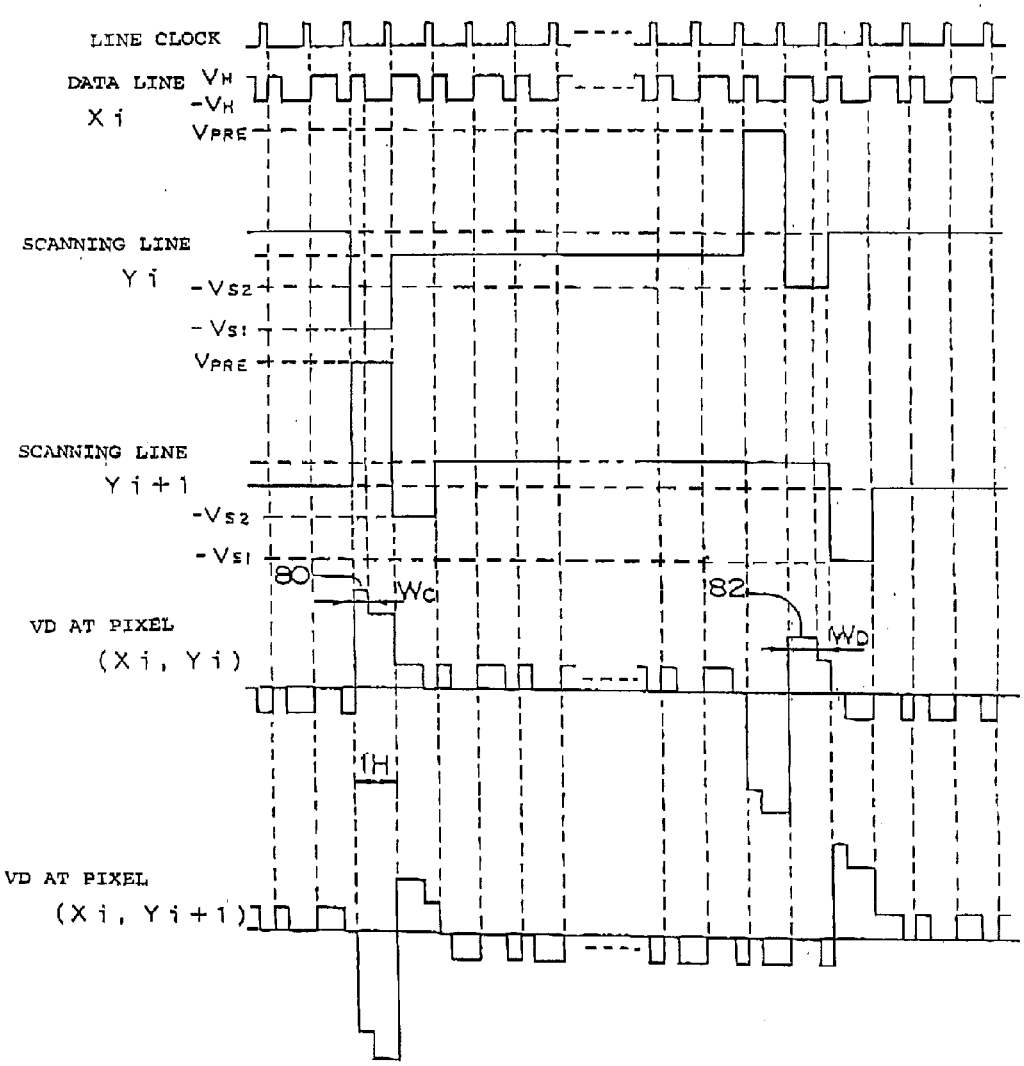

For example, in a case where OFF display is made on regions R2, R2, R3, and R4 while ON display is made on a region R5, that is, bright display (R5) is made with a dark background (R1, R2, R3, and R4), there is a possibility of occurrence of a vertical crosstalk, such as that shown in FIG. 12 (A), in the regions R3 and R4 above and below the region R5. Such a vertical crosstalk can be reduced substantially effectively by performing 1H inverting drive (driving by inverting the polarity of the liquid crystal applied voltage with respect to each scanning line). However, if area grayshade display (a grayshade made by changing the ratio of the number of ON pixels and the number of OFF pixels in each of pixel units consisting of a plurality of pixels) or zebra display such as shown in FIG. 12(B) or 12(C) is made on the region R5, a vertical crosstalk occurs even if 1H inverting drive is performed. According to this embodiment, even in such a situation, the DC component of the data voltage is zero independent of the gray scale, and the ON voltage period and the OFF voltage period in one horizontal scanning period is 1:1 independent of the display pattern, thus preventing occurrence of a vertical crosstalk such as that shown in FIG. 12(D).

As drive waveforms for keeping the DC component of the data voltage zero independent of the gray scale, those shown in FIGS. 10 and 11(A) to (D) are particularly preferred considering ease of waveform formation and ease of control. However, other various waveforms equivalent to these are also available.

(Third Embodiment)

Figure 13:
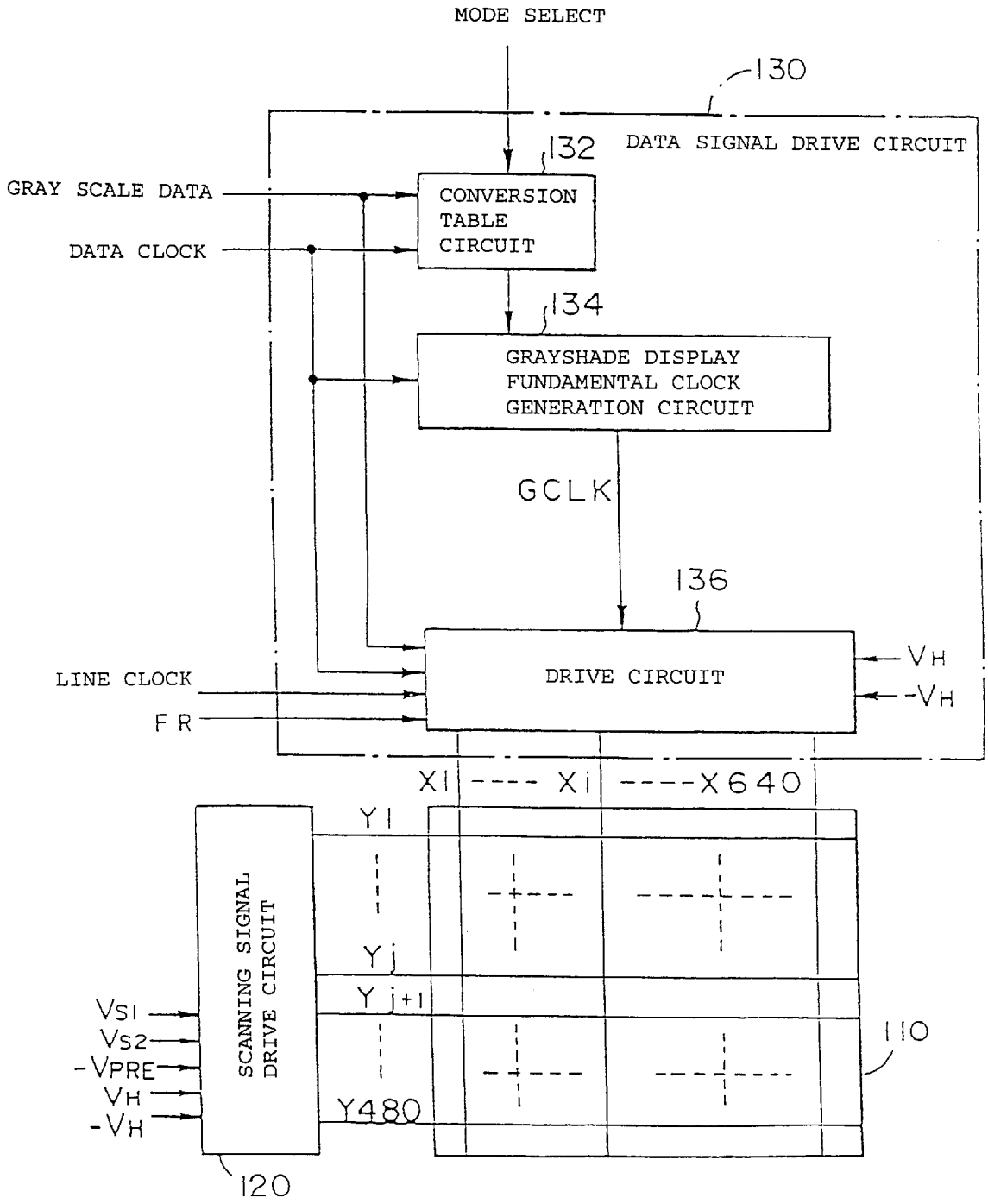
FIG. 13 is a diagram showing the configuration a liquid crystal display device of a third embodiment.

The third embodiment relates to details of an example of a liquid crystal display device arranged in accordance with the first and second embodiments. As shown in FIG. 13, this liquid crystal display device includes a liquid crystal panel 110, a scanning signal drive circuit 120, and a data signal drive circuit 130. The data signal drive circuit 130 includes a conversion table circuit 132, a grayshade display fundamental clock generation circuit 134, and a drive circuit 136.

Figure 14:
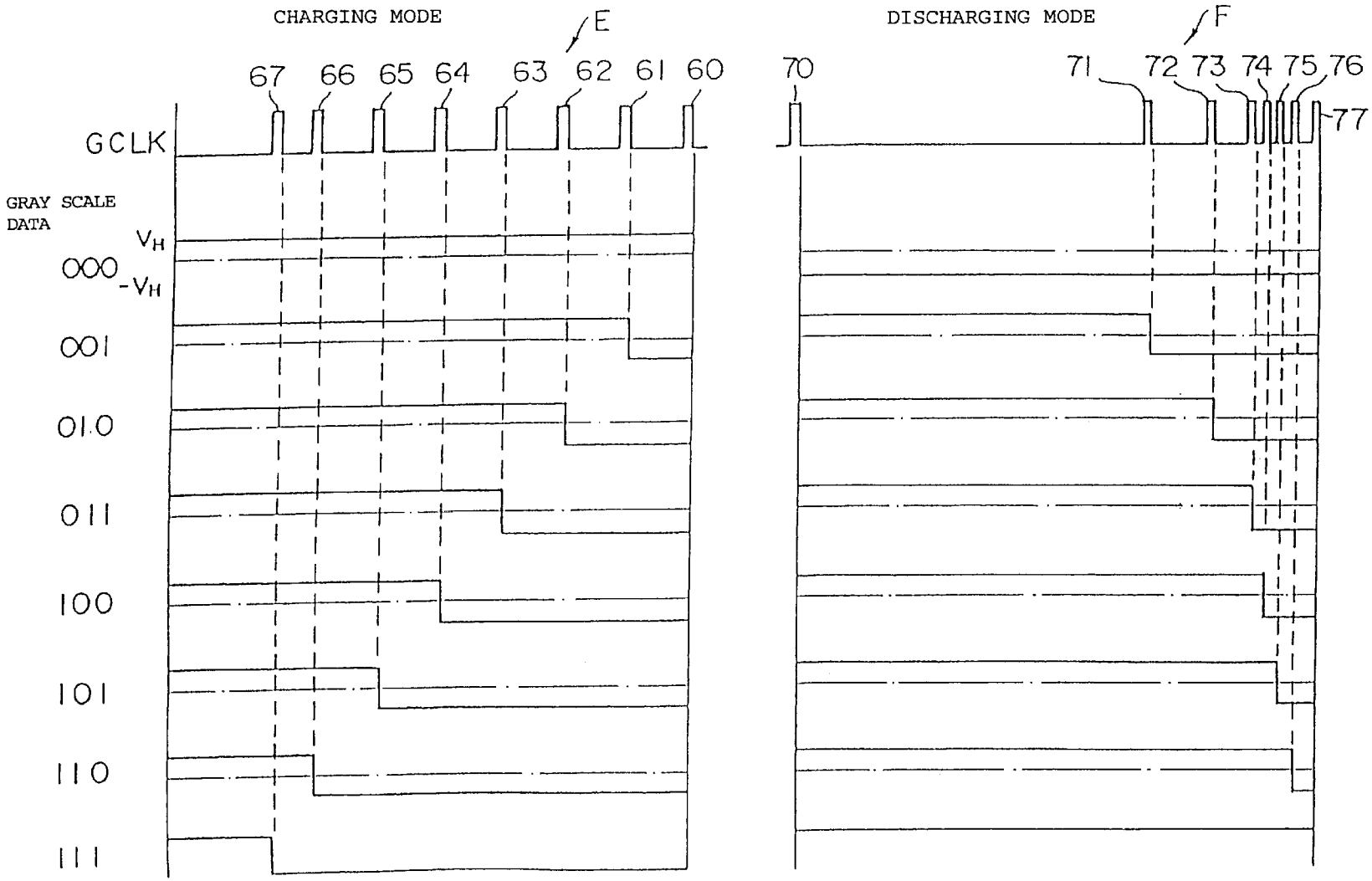
FIG. 14 is a diagram for explaining the operation of the third embodiment.

The grayshade display fundamental clock generation circuit 134 generates a grayshade display fundamental clock GCLK shown in FIG. 14. The generated GCLK is output to the drive circuit 136. As shown in FIG. 13, GCLK is output in accordance with different timings with respect to the charging and discharging modes. GCLK is a signal for determining timing of applying the data voltage to each liquid crystal element according to each value of gray scale data.

For example, in the charging mode, the drive circuit 136 is supplied with GCLK by timing indicated at E in FIG. 14. If the gray scale data is (001), the drive circuit 136 changes the data voltage from VH to −VH by the fall of a pulse 61 of GCLK. Similarly, if the gray scale data is (010), the drive circuit 136 changes the data voltage from VH to −VH by the fall of a pulse 62 of GCLK.

On the other hand, in the discharging mode, the drive circuit 136 is supplied with GCLK by timing indicated at F in FIG. 14. If the gray scale data is (001), the drive circuit 136 changes the data voltage from VH to −VH by the fall of a pulse 71 of GCLK. Similarly, if the gray scale data is (010), the drive circuit 136 changes the data voltage from VH to −VH by the fall of a pulse 72 of GCLK. Thus, grayshade display with different write pulse widths set with respect to the charging and discharging modes can be performed.

Figure 15:
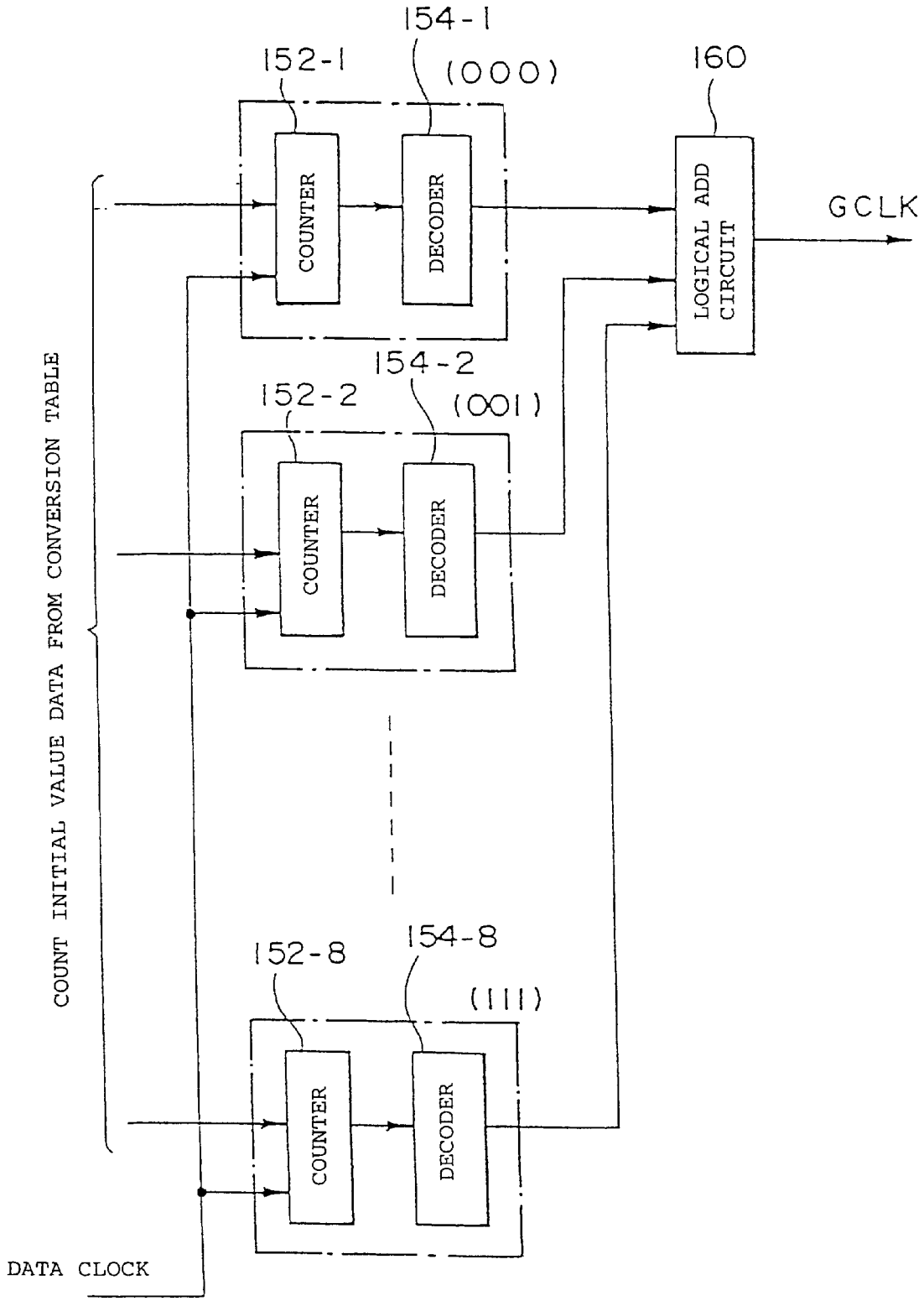
FIG. 15 is a diagram showing an example of arrangement of a grayshade display fundamental clock generation circuit.

FIG. 15 shows an example of arrangement of the grayshade display fundamental clock generation circuit 134. As shown in FIG. 15, this grayshade display fundamental clock generation circuit 134 includes counters 152-1, 152-2, . . . , 152-8, decoders 154-1, 154-2, . . . , 154-8, and a logical add circuit 160. The counter 152-1 and the decoder 154-1 correspond to gray scale data (000), the counter 152-2 and the decoder 154-2 correspond to gray scale data (010), . . . , and the counter 152-8 and the decoder 154-8 correspond to gray scale data (111).

The counters 152-1 to 152-8 are supplied with count initial value data from the conversion table circuit 132 shown in FIG. 13, and perform the count-up (or countdown) operation from an initial state corresponding to the count initial value data. The decoders 154-1 to 154-8 form pulses of GCLK by decoding outputs from the counters 152-1 to 152-8. In the charging mode, for example, the decoder 154-1 forms pulse 60 shown in FIG. 14, the decoder 154-2 forms pulse 61, . . . , and the decoder 154-8 forms pulse 67. In the discharging mode, the decoder 154-1 forms pulse 70, the decoder 154-2 forms pulse 71, . . . , and the decoder 154-8 forms pulse 77. The logical add circuit 160 logically combines outputs from the decoders 154-1 to 1548, thereby forming GCLK.

In this embodiment, the counters 152-1 to 152-8 are loaded with different groups of count initial value data with respect to the charging and discharging modes. For example, in the charging mode, if the gray scale data is (001), count initial value data for generating pulse 61 by the timing shown in FIG. 14 is loaded from the conversion table circuit 132 into the counter 152-2. On the other hand, in the discharging mode, if the gray scale data is (001), count initial value data for generating pulse 71 by the timing shown in FIG. 14 is loaded from the conversion table circuit 132 into the counter 152-2.

The conversion table circuit 132 determines one of the charging and discharging modes according to a mode select signal shown in FIG. 13, and outputs count initial value data corresponding to the determined mode to the grayshade display fundamental clock generation circuit 134. The conversion table circuit 132 incorporates a conversion table memory in which the above-described count initial data is stored so that the pulse widths $W_C$ and $W_D$ of write pulses in the charging and discharging modes have the relationship shown in FIG. 7(B).

The drive circuit 136 shown in FIG. 13 also has a function of forming data signals in the periods T1 and T3 from data signals in the periods T2 and T4 shown in FIGS. 11(A) and 11(B). This can be achieved by forming signals in the inverted relationship with the data signals in the periods T2 and T4 and by outputting the formed signals before outputting the data signals in the periods T2 and T4.

The fourth embodiment relates to electronic apparatuses including the liquid crystal display device described above with respect to the first to third embodiments.

Various electronic apparatuses will be described with reference to FIGS. 16 to 21(C).

Figure 16:
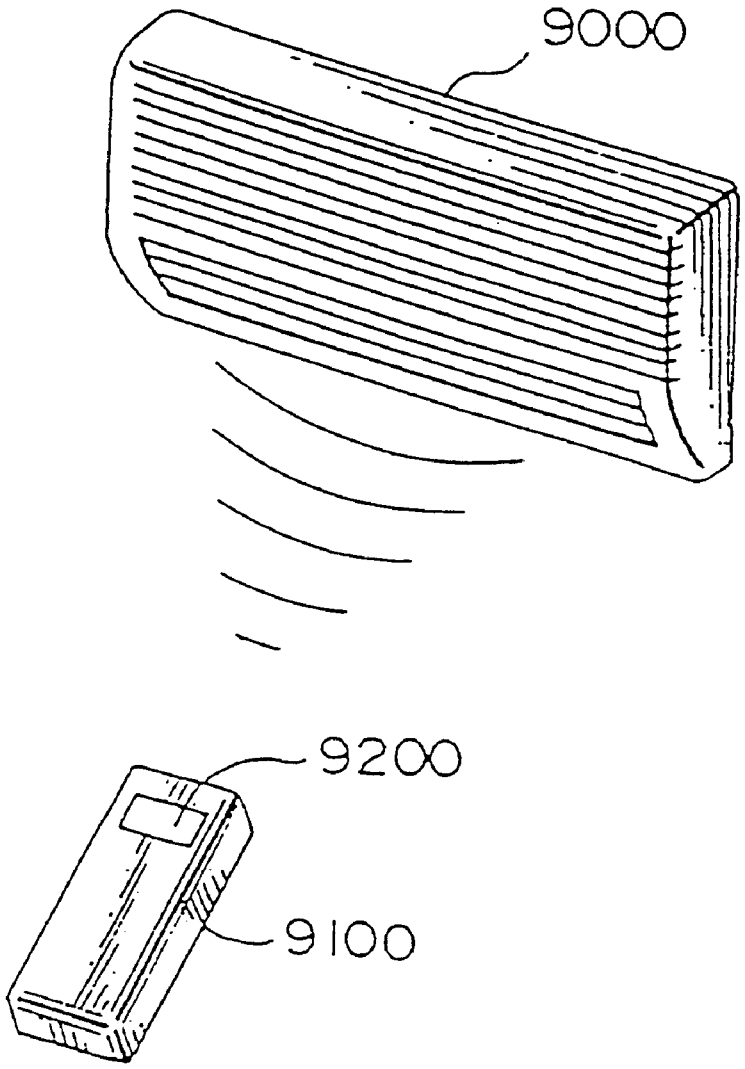
FIG. 16 is a diagram showing an example of a remote controller as an electronic apparatus.

Referring to FIG. 16, a microcomputer is incorporated in a remote controller 9100 for an air controller 9000. The controller 9100 controls the air controller 9000 and has a liquid crystal display device 9200, which displays the operating state of the air controller, etc.

Figure 17:
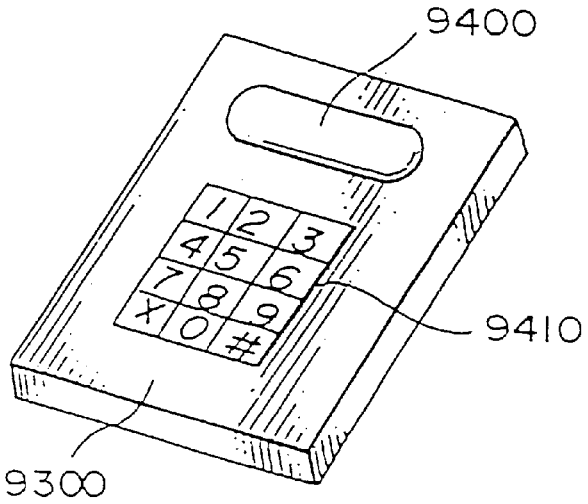
FIG. 17 is a diagram showing an example of an electronic calculator as an electronic apparatus.

Referring to FIG. 17, a microcomputer is incorporated in an electronic calculator 9300, which has input keys 9410 and a liquid crystal display device 9400.

Figure 18:
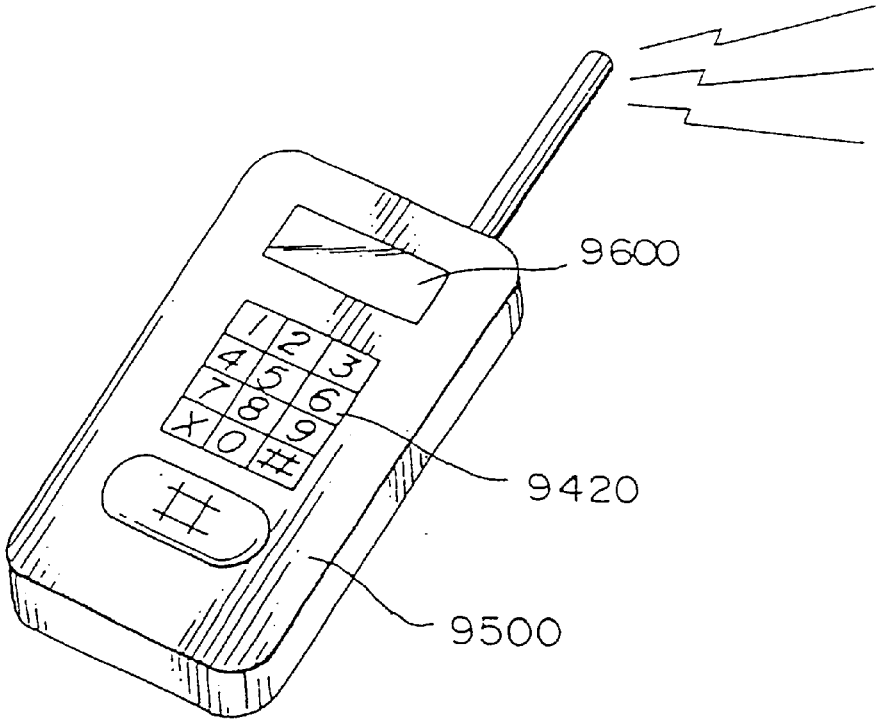
FIG. 18 is a diagram showing an example of a portable telephone set as an electronic apparatus.

Referring to FIG. 18, a microcomputer is incorporated in a portable telephone set 9500, which has input keys 9420 and a liquid crystal display device 9600.

Figure 19:
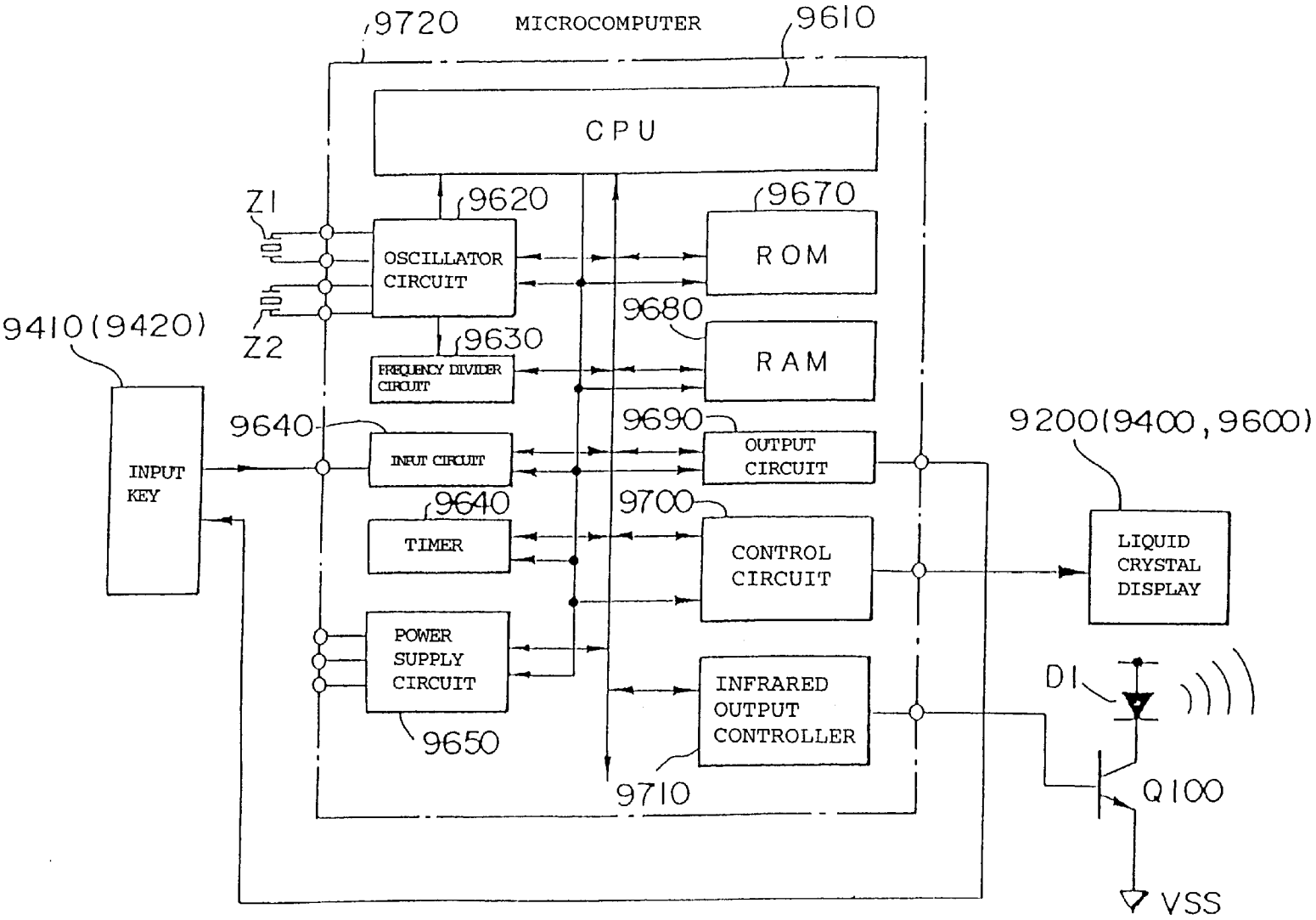
FIG. 19 is a diagram showing the overall configuration of a control circuit of a liquid crystal device incorporated in an electronic apparatus.

The above-described electronic apparatuses are, for example, portable electronic apparatuses using batteries (including solar cells). FIG. 19 schematically shows the overall configuration of a control circuit of a liquid crystal display device incorporated in such electronic apparatuses.

A microcomputer 9720 shown in FIG. 19 is incorporated in the controller for the air controller shown in FIG. 16. However, it can also be applied to electronic apparatuses such as those shown in FIGS. 17 and 18.

The microcomputer 9720 shown in FIG. 19 includes a CPU 9610, an oscillator circuit 9620, a frequency divider circuit 9630, an input circuit 9640, a timer circuit 9645, a power supply circuit 9650, a ROM 9670, a RAM 9680, an output circuit 9690, a control circuit 9700, an infrared output controller 9710, etc.

The input circuit 9640 and the output circuit 9690 are, for example, communication interface circuits interfacing with the input keys 9410 or the like. The control circuit 9700 is a circuit for controlling the liquid crystal display device 9200 and so on to make the displays of various states. The infrared output controller 9710 is a circuit for on/off-drives an infrared emitting diode D1 through a switching transistor Q100.

Figure 20:
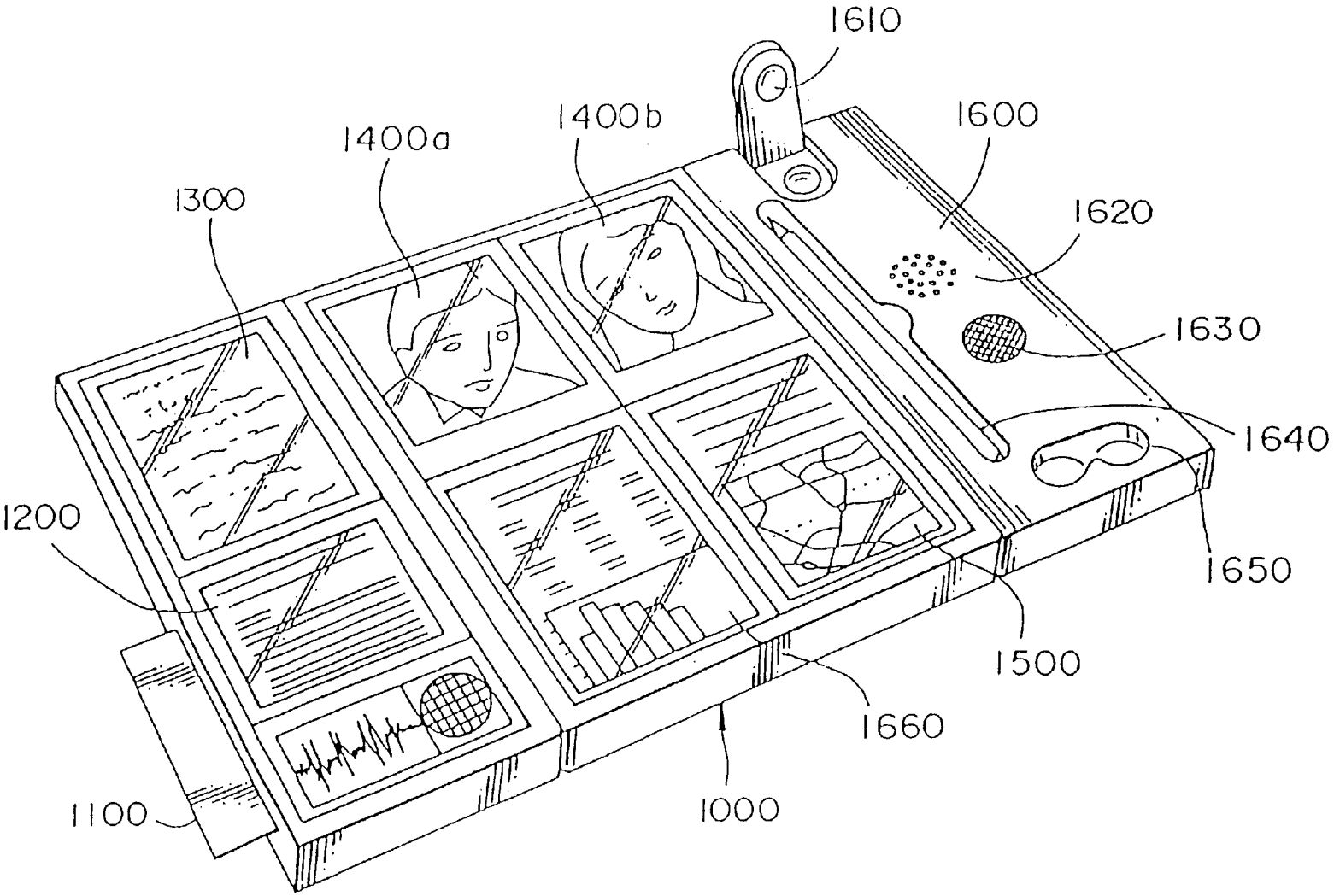
FIG. 20 is a diagram showing an example of a personal portable information apparatus as an electronic apparatus.
Figure 21:
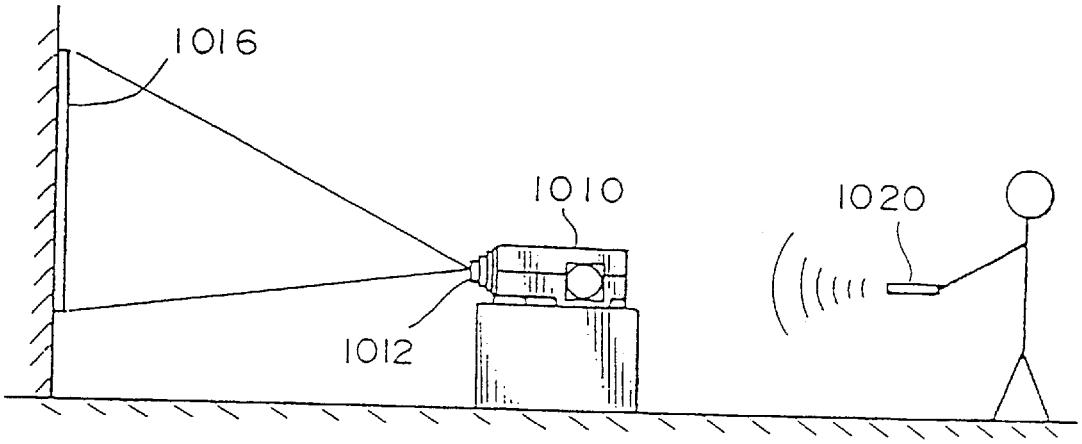
FIGS. 21(A), 21(B), and 21(C) are diagrams showing an example of a liquid crystal projector as an electronic apparatus.
Figure 21:
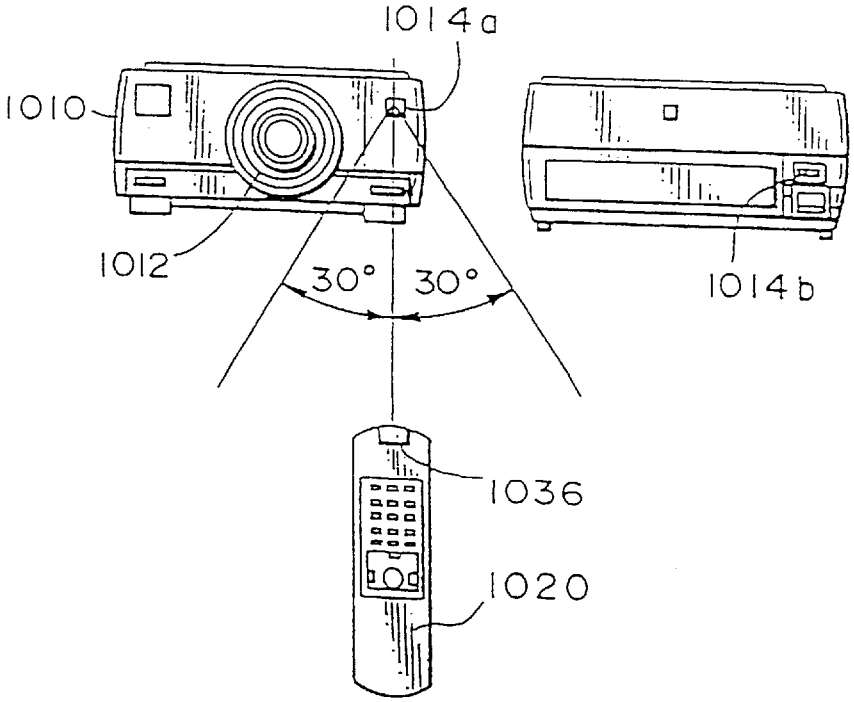

The liquid crystal display device described with respect to the first to third embodiments can also be used in a personal portable information apparatus (personal digital assistance) 1000 such as that shown in FIG. 20.

This information apparatus 1000 has an IC card 1100, a simultaneous translation system 1200, a handwriting screen 1300, TV conference systems 1400*a* and 1400*b*, map information system 1500, and a data preparation system 1660. Image displays for these systems are made by the liquid crystal display device of the first to third embodiments. The information apparatus 1000 further has, in an input and output interface unit 1600, a video camera 1610, a speaker 1620, a microphone 1630, an input pen 1640, and an earphone 1650.

The liquid crystal display device described with respect to the first to third embodiments can also be applied to a liquid crystal projector 1010, such as that shown in FIGS. 21(A), 21(B), and 21(C), which is a kind of electronic apparatus. FIG. 21(A) illustrates a state where a given image is projected from a projection opening 1012 onto a display area set as desired, e.g., a screen 1016. An infrared emitting portion 1036 is provided in the remote controller 1020 at a front end to transmit an operating signal to the liquid crystal projector 1010. As shown in FIGS. 21(B) and 21(C), infrared receiving portions 1014*a* and 1014*b* are provided in front and rear surfaces of the liquid crystal projector 1010, thereby enabling an operator to remote-control the liquid crystal projector 1010 on each of the front and rear sides.

The present invention is not limited to the above-described first to fourth embodiments. The present invention can be modified in other various ways without departing from the gist of the invention.

For example, the first and second embodiments may be combined to provide a liquid crystal device or the like having further improved display characteristic.

Figure 22:
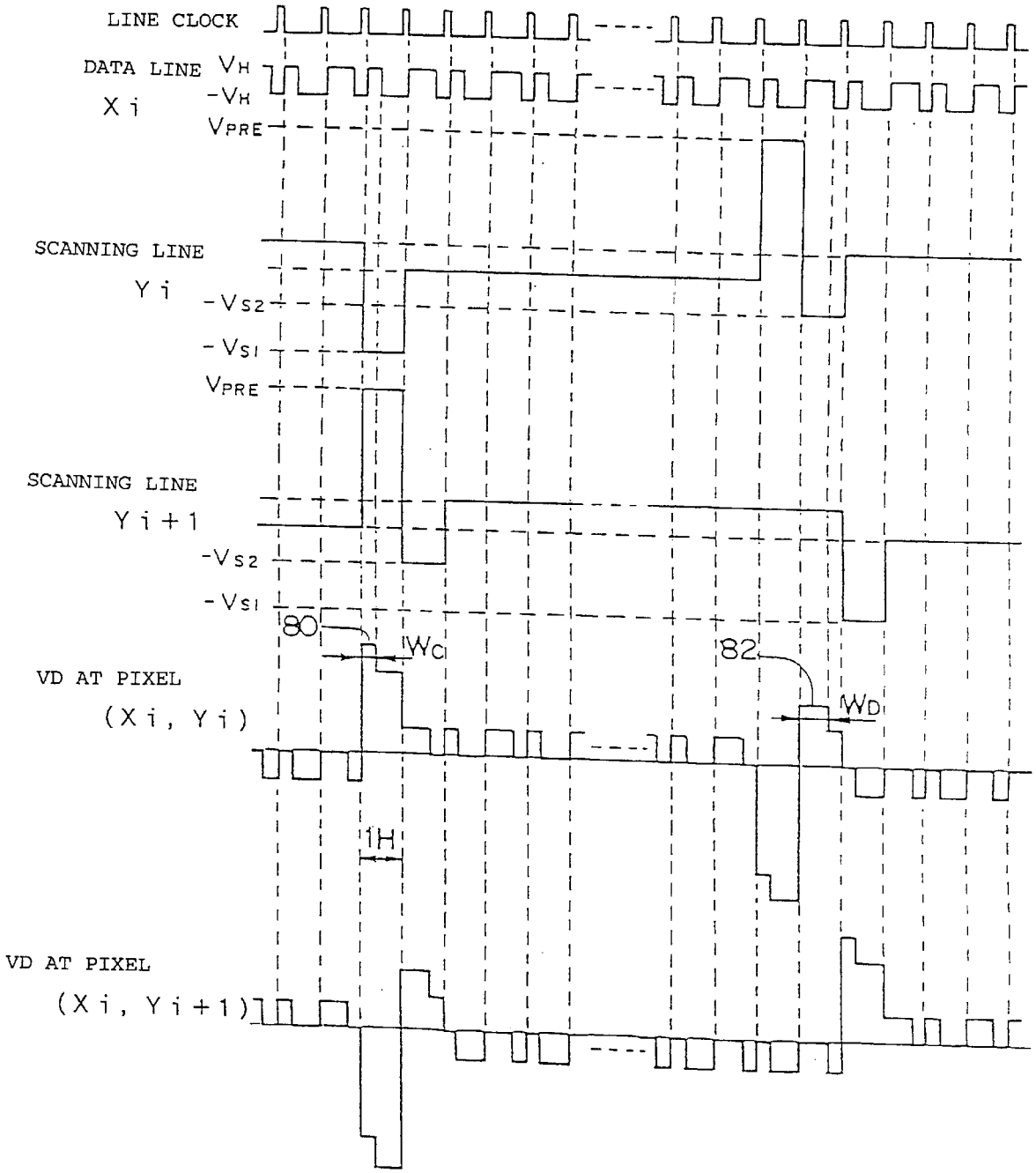
FIG. 22 is a diagram showing an example of a modification of the drive waveforms.
Figure 1:
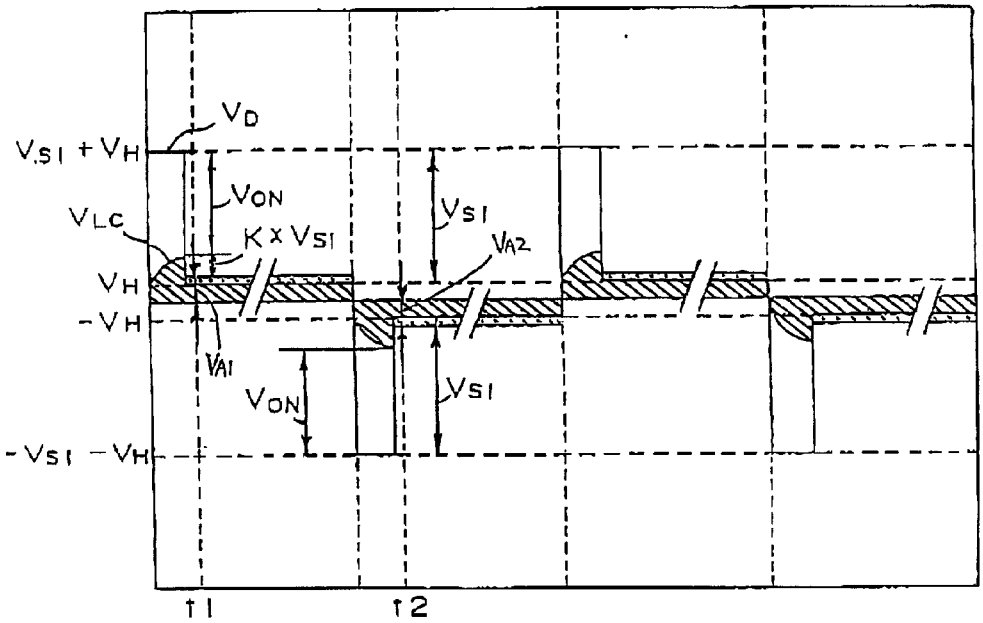
Prior Art Fig. 1
Figure 2:
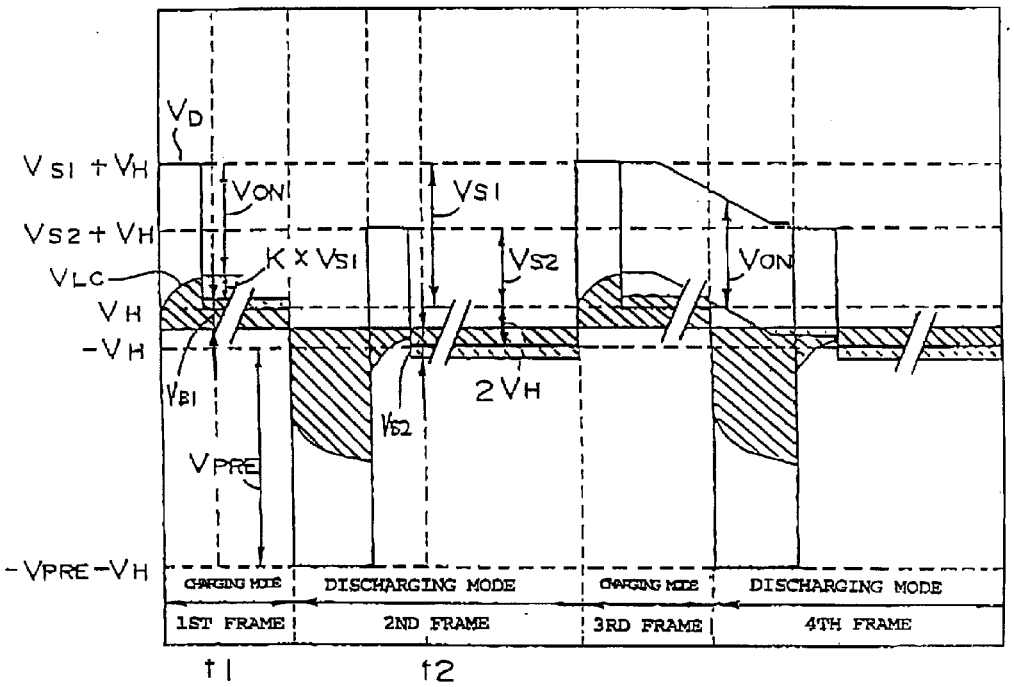
Prior Art Fig. 2

The drive waveforms in accordance with the present invention are not limited to those described with respect to the first to third embodiments, and can be modified in various ways. For example, FIG. 22 shows an example of the drive waveforms in the case where the selecting period is 1H, different from that shown in FIG. 10. Also referring to FIG. 22, in comparison with FIG. 10, write pulses 80 and 82 are shifted into the first half of the selecting period. By shifting write pulses into the front half in this manner, gentler gray scale steps can be obtained to enable accurate grayshade representation. In FIGS. 10 and 22, examples of the waveforms for 1H inverting drive are illustrated. However, nH inverting drive (drive of inverting the polarity at every nth scanning lines) may be performed instead of 1H inverting drive. It is also possible to perform only frame inverting drive without performing 1H inverting drive.

The drive waveforms of the charge-discharge drive method to which the present invention can be applied are not limited to those such as shown in FIGS. 2, 5(A), and 5(B).

The arrangement of the display device with which the present invention can be realized is not limited to that shown in FIG. 13, and any other arrangement may also be used.

The kind of display device to which the present invention is applied is not limited to a liquid crystal display device, and the display element is not limited to a liquid crystal element.

INDUSTRIAL APPLICABILITY

The present invention is a drive method most suitably used as a charge-discharge method, and is useful in the case of use as a display device capable of grayshade display by pulse width modulation, and is suitable for use as a display device having an improved display characteristic in an electronic apparatus.

What is claimed is:

1. A display device including a plurality of scanning lines, a plurality of data lines, and display elements driven with the scanning lines and the data lines, said display device performing grayshade display by pulse width modulation, said display device comprising: scanning signal drive means for supplying a first selecting voltage to the scanning lines in a first mode, and for supplying, in a second mode, a precharge voltage opposite in polarity to the first selecting voltage about a middle value of a data voltage applied to the data lines and thereafter supplying a second selecting voltage opposite in polarity to the precharge voltage about the middle value of the data voltage to the scanning lines; and data signal drive means for supplying a pulse-width-modulated data voltage to the data lines, wherein a DC component of the data voltage in one horizontal scanning period with respect to a middle voltage between an ON voltage and an OFF voltage is made approximately zero independent of a gray scale wherein said scanning signal drive means supplies, in said first mode, said first selecting voltage in a second period following a first period corresponding to a first half of one horizontal scanning period and equal in length to the first period, and supplies, in said second mode, said precharge voltage in a third period corresponding to the first half of one horizontal scanning period, and said second selecting voltage in a fourth period following the third period and equal in length to the third period, and wherein said data signal drive means keeps the data voltage at a low level with respect to the middle voltage of the ON and OFF voltages for a period in said first period equal in length to a period in said second period through which the data voltage is kept at a high level with respect to the middle voltage, keeps the data voltage at the high level for a period in said first period equal in length to the period in said second period through which the data voltage is kept at the low level, keeps the data voltage at the low level for a period in said third period equal in length to a period in said fourth period through which the data voltage is kept at the high level, and keeps the data voltage at the high level for a period in said third period equal in length to a period in said fourth period through which the data voltage is kept at the low level.

2. A liquid crystal display device including;

a plurality of liquid crystal display elements driven by selectively applying voltages having two polarities, a plurality of switching elements connected in series to the liquid crystal display elements that serve to select the liquid crystal display elements, a plurality of scanning lines each connected to one element of one liquid crystal display element of the liquid crystal display elements and one switching element of the switching elements connected in series to the one liquid crystal display element that are used for applying a selecting signal to the one switching element for selecting the one liquid crystal display element, and a plurality of data lines each connected to another element of the one liquid crystal display element and the one switching element that are used for applying a data pulse defining a gray scale that the one liquid crystal display element should display, to the one liquid crystal display element connected in series to the one switching element turned on by the selecting signal applied to one scanning line of the scanning lines, the liquid crystal display device comprising:

a scanning signal drive circuit wherein said scanning signal drive circuit drives the one liquid crystal display element by a voltage having one polarity of the two polarities, turns on the one switching element by applying a first selecting signal having the one polarity to the one scanning line in a first horizontal scanning period assigned for selecting the one liquid crystal display element to select the one liquid crystal display element, so as to drive the one liquid crystal display element by a voltage having the other polarity of the two polarities in a second horizontal scanning period for selecting the one liquid crystal display element following the first horizontal scanning period, applying a precharge voltage having the other polarity to the one scanning line prior to the second horizontal scanning period, and turning on the one switching element by applying a second selecting signal having the one polarity to the one scanning line in the second horizontal scanning period to select the one liquid crystal display element; and a data signal drive circuit that by applying, to one data line of the data lines connected to the one liquid crystal display element, a first data pulse defining a first gray scale that the one liquid crystal display element selected by the first selecting signal should display, applies to the one crystal display element a first voltage difference that is a voltage difference between the first selecting signal and the first data pulse, by applying to the one data line a second data pulse defining a second gray scale that the one liquid crystal display element selected by the second selecting signal should display, applies to the one liquid crystal display element a second voltage difference that is a voltage difference between the second selecting signal and the second data pulse, wherein the data signal drive circuit renders substantially the same as the first gray scale that the one liquid crystal display element displays based on the first voltage difference and the second gray scale that the one liquid crystal display element displays based on the second voltage difference by controlling pulse widths of the first and second data pulses so that one pulse width thereof is reduced and a rate of the reduction becomes lower as the other pulse width thereof is increased.

3. The liquid crystal display device of claim 2, wherein the pulse widths of the first and second data pulses are so defined that an absolute value of a voltage held by the one liquid crystal display element to which the first voltage difference is applied and an absolute value of a voltage held by the one liquid crystal display element to which the second voltage difference is applied are substantially equivalent to each other.

4. The liquid crystal display device of claim 2, wherein lengths of periods during which the first and second selecting signals are applied in the first and second horizontal scanning periods are half the lengths of the first and second horizontal scanning periods, respectively.

5. The liquid crystal display device of claim 2, wherein the switching elements are MIM elements.

6. An electronic apparatus comprising the liquid crystal display device of claim 2, wherein the liquid crystal display device displays an image relevant to the electronic apparatus.

* * * * *

UNITED STATES PATENT AND TRADEMARK OFFICE

CERTIFICATE OF CORRECTION

PATENT NO. : 6,342,881 B1
DATED : January 29, 2002
INVENTOR(S) : Akira Inoue

It is certified that error appears in the above-identified patent and that said Letters Patent is hereby corrected as shown below:

Delete the title page and insert the title page as shown on attached page.

In the drawings, sheets 1-21, consisting of figs. 1-22 should be replaced with the corrected drawing sheets 1-21, consisting of figs. 1-22 as shown on the attached pages.

Column 4,
Line 17, after "configuration" insert -- of --.

Column 5,
Line 3, "($C_H$" should be -- ($C_M$ --.
Line 30, "=K" should be -- -K --.
Line 48, "$VB_2$" should be -- $V_{B2}$ --.

Column 7,
Line 49, "$T_1$" should be -- T1 --.

Column 8,
Line 15, 2nd occurrence of "11(C)" should be -- 11(D) --.
Line 24, 1st occurrence of "R2" should be -- R1 --.

Column 9,
Line 40, "1548" should be -- 154-8 --.

Column 12,
Line 18, "including;" should be -- including: --.

Signed and Sealed this

Eighth Day of July, 2003

JAMES E. ROGAN
*Director of the United States Patent and Trademark Office*

(12) United States Patent
Inoue

(10) Patent No.: US 6,342,881 B1
(45) Date of Patent: Jan. 29, 2002

(54) DISPLAY DEVICE, ELECTRONIC EQUIPMENT, AND DRIVING METHOD

(75) Inventor: Akira Inoue, Nagano (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 09/051,764

(22) PCT Filed: Aug. 11, 1997

(86) PCT No.: PCT/JP97/02814

§ 371 Date: Jul. 24, 1998

§ 102(e) Date: Jul. 24, 1998

(87) PCT Pub. No.: WO98/08133

PCT Pub. Date: Feb. 26, 1998

(30) Foreign Application Priority Data

Aug. 16, 1996 (JP) ..... 8-234695

(51) Int. Cl.[7] ..... G09G 3/36

(52) U.S. Cl. ..... 345/204; 345/94; 345/89; 345/95; 345/96; 345/98; 345/208; 345/209; 345/210

(58) Field of Search ..... 345/89, 94, 95, 345/96, 98, 208, 209, 210, 84, 204

(56) References Cited

U.S. PATENT DOCUMENTS

| | | | | | |
|---|---|---|---|---|---|
| 5,159,325 | A | * | 10/1992 | Kuijk et al. | 345/84 |
| 5,233,340 | A | * | 8/1993 | Yamaguchi et al. | 345/148 |
| 5,317,334 | A | * | 5/1994 | Sano | 345/148 |
| 5,534,889 | A | * | 7/1996 | Reents et al. | 345/132 |
| 5,619,224 | A | * | 4/1997 | Hoshino et al. | 345/98 |
| 5,689,281 | A | * | 11/1997 | Nomura | 348/94 |
| 5,719,590 | A | * | 2/1998 | Shimada et al. | 345/94 |
| 5,815,131 | A | * | 9/1998 | Taniguchi et al. | 345/94 |
| 6,069,603 | A | * | 5/2000 | Knapp | 345/91 |

FOREIGN PATENT DOCUMENTS

| | | | |
|---|---|---|---|
| JP | 62-189434 | * | 8/1987 |
| JP | 2-125225 | | 5/1990 |
| JP | 5-93898 | | 4/1993 |
| JP | 6-301011 | | 10/1994 |
| JP | 10082980 | * | 3/1998 |

* cited by examiner

*Primary Examiner*—Bipin Shalwala
*Assistant Examiner*—Vincent E. Kovalick
(74) *Attorney, Agent, or Firm*—Harness, Dickey & Pierce, P.L.C.

(57) ABSTRACT

A display device, an electronic apparatus, and a drive method are provided achieving an improved display characteristic, most suitable for a charge-discharge drive method and arranged to perform grayshade display by pulse width modulation. In a charging mode, a first selecting voltage $V_{S1}$ is supplied to a scanning line. In a discharging mode, a precharge voltage–$V_{PRE}$ opposite in polarity to $V_{S1}$ is applied to the scanning line, and a second selecting voltage $V_{S2}$ opposite in polarity to the precharge voltage–$V_{PRE}$ is thereafter supplied to the scanning line. Also, a pulse-width-modulated data voltage is supplied to a data line. As the pulse width of one of first and second write pulses 44 and 46 setting the same gray scale value is increased, the pulse width of the other is reduced and the rate of reduction of the pulse width of the other becomes lower. The DC component of the data voltage in one horizontal scanning period is made approximately zero independent of the gray scale.

6 Claims, 21 Drawing Sheets

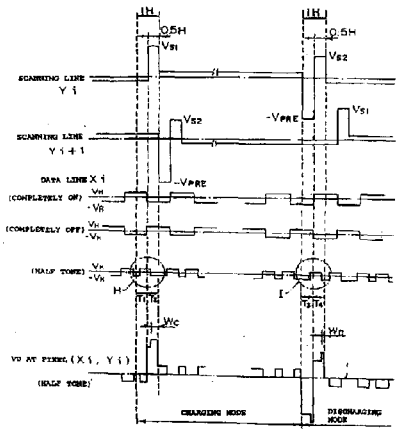

CHARGING MODE

DISCHARGING MODE

CHARGING MODE

DISCHARGING MODE

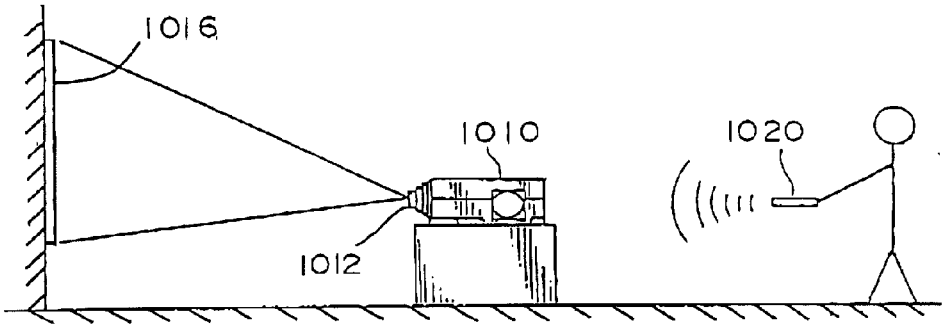
Fig. 21A
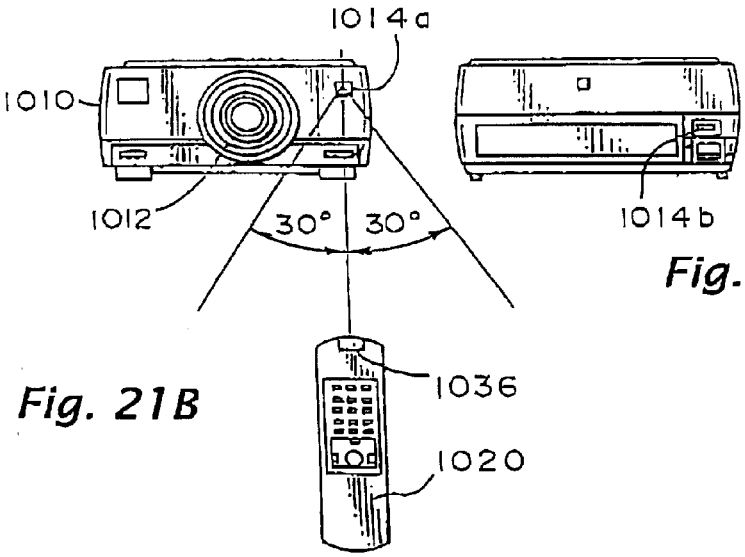
Fig. 21B
Fig. 21C